US007404223B2

(12) United States Patent
Manuszak et al.

(10) Patent No.: US 7,404,223 B2
(45) Date of Patent: Jul. 29, 2008

(54) INNERSPRING COILS AND INNERSPRINGS WITH NON-HELICAL SEGMENTS

(75) Inventors: Brian M. Manuszak, Thomasville, NC (US); Larry K. DeMoss, Jamestown, NC (US); James A. Beamon, Jamestown, NC (US)

(73) Assignee: Sealy Technology LLC, Trinity, NC (US)

( * ) Notice: Subject to any disclaimer, the term of this patent is extended or adjusted under 35 U.S.C. 154(b) by 0 days.

(21) Appl. No.: 11/708,099

(22) Filed: Feb. 20, 2007

(65) Prior Publication Data

US 2007/0169275 A1 Jul. 26, 2007

Related U.S. Application Data

(63) Continuation-in-part of application No. 10/929,137, filed on Aug. 28, 2004, now Pat. No. 7,178,187.

(51) Int. Cl.

| | |
|---|---|
| ***A47C 23/04*** | (2006.01) |
| ***A47C 27/07*** | (2006.01) |
| ***F16F 1/06*** | (2006.01) |
| ***F16F 3/04*** | (2006.01) |

(52) U.S. Cl. ..... 5/716; 5/248; 5/256; 5/269; 267/91; 267/166; 267/180

(58) Field of Classification Search ..... 5/716, 5/248, 251, 256, 269, 655.7; 267/91, 103, 267/166, 167, 166.1, 180

See application file for complete search history.

(56) References Cited

U.S. PATENT DOCUMENTS

| | | | | |
|---|---|---|---|---|
| 184,703 | A | 11/1876 | De Camp | |
| 399,867 | A * | 3/1889 | Gail et al. | 5/250 |
| 1,025,489 | A * | 5/1912 | Thompson | 5/256 |
| 1,211,267 | A | 1/1917 | Young | |
| 1,337,320 | A | 4/1920 | Karr | |
| 1,344,636 | A * | 6/1920 | Jackson | 5/263 |
| 1,839,325 | A * | 1/1932 | Marquardt | 5/269 |
| 1,907,324 | A | 5/1933 | Kirchner | |
| 1,938,489 | A | 12/1933 | Karr | |
| 1,950,770 | A | 3/1934 | Bayer | |
| 1,989,302 | A | 1/1935 | Wilmot | |
| 2,054,868 | A | 9/1936 | Schwartzman | |
| 2,148,961 | A * | 2/1939 | Pleet | 267/91 |
| 2,214,135 | A | 9/1940 | Hickman | |
| 2,348,897 | A | 5/1944 | Gladstone | |
| 2,480,158 | A * | 8/1949 | Owen | 267/91 |
| 2,562,099 | A | 7/1951 | Hilton | |
| 2,611,910 | A | 9/1952 | Bell | |

(Continued)

FOREIGN PATENT DOCUMENTS

| | | |
|---|---|---|
| GB | 494428 | 10/1938 |

*Primary Examiner*—Robert G Santos
(74) *Attorney, Agent, or Firm*—Roetzel & Andress

(57) ABSTRACT

Innerspring coils for innersprings for mattresses and other reflexive support structures, have generally helical coil bodies and at least one non-helical segment or step which extends between one or both axial ends of the coil body and one or both of the coil ends. The step or steps may be linear or non-linear, and parallel to or angularly disposed with respect to a longitudinal axis of the coil body. When located proximate to a coil end, the step extends out of the plane in which the coil end lies. One or more steps may alternatively be formed intermediate to helical turns of the helical coil body.

17 Claims, 24 Drawing Sheets

U.S. PATENT DOCUMENTS

| | | | | | |
|---|---|---|---|---|---|
| 2,617,124 | A | | 11/1952 | Johnson | |
| 2,889,562 | A | * | 9/1959 | Gleason | 5/248 |
| 2,972,154 | A | * | 2/1961 | Raszinski | 5/721 |
| 3,089,154 | A | | 5/1963 | Boyles | |
| 3,107,367 | A | | 10/1963 | Nachman, Jr. | |
| 3,517,398 | A | | 6/1970 | Patton | |
| 3,533,114 | A | | 10/1970 | Karpen | |
| 3,923,293 | A | | 12/1975 | Wiegand | |
| 4,122,566 | A | | 10/1978 | Yates | |
| 4,566,926 | A | | 1/1986 | Stumpf | |
| 4,578,834 | A | | 4/1986 | Stumpf | |
| 4,609,186 | A | | 9/1986 | Thoenen | |
| 4,726,572 | A | | 2/1988 | Flesher et al. | |
| 4,781,360 | A | | 11/1988 | Ramsey | |
| 4,817,924 | A | | 4/1989 | Thoenen | |
| 4,960,267 | A | | 10/1990 | Scott | |
| 5,040,255 | A | * | 8/1991 | Barber, Jr. | 5/720 |
| 5,575,460 | A | * | 11/1996 | Knopfel | 267/91 |
| 5,584,083 | A | * | 12/1996 | Ramsey et al. | 5/271 |
| 5,713,088 | A | | 2/1998 | Wagner et al. | |
| 5,724,686 | A | | 3/1998 | Neal | |
| 6,375,169 | B1 | | 4/2002 | McCraw et al. | |
| 6,931,685 | B2 | * | 8/2005 | Kuchel et al. | 5/716 |
| 7,168,117 | B2 | | 1/2007 | Gladney et al. | |
| 7,178,187 | B2 | * | 2/2007 | Barman et al. | 5/716 |
| 2004/0046297 | A1 | * | 3/2004 | DeMoss et al. | 267/142 |
| 2006/0042016 | A1 | * | 3/2006 | Barman et al. | 5/716 |
| 2007/0169275 | A1 | * | 7/2007 | Manuszak et al. | 5/716 |
| 2008/0017255 | A1 | * | 1/2008 | Petersen | 137/522 |

* cited by examiner

INNERSPRING COILS AND INNERSPRINGS WITH NON-HELICAL SEGMENTS

RELATED APPLICATIONS

This application is a continuation-in-part of U.S. application Ser. No. 10/929,137, filed Aug. 28, 2004 now U.S. Pat. No. 7,178,187.

FIELD OF THE INVENTION

The present invention is in the general field of spring and coil designs and reflexive systems which utilize a plurality of springs or coils.

BACKGROUND OF THE INVENTION

Mattress innersprings, or simply "innersprings", made of matrices or arrays of a plurality of wire form springs or coils, have long been used as the reflexive core of a mattress padding and upholstery is arranged and attached around the innerspring. Innersprings made of formed steel wire are mass produced by machinery which forms the coils from steel wire stock and interconnects or laces the coils together in the matrix array. With such machinery, design attributes of innersprings can be selected and modified, from the gauge of the wire, the coil design or combinations of designs, coil orientation relative to adjacent coils in the matrix array, and the manner of interconnection or lacing of the coils.

Mattresses and other types of cushions have for decades been constructed to be "double-sided" or in other words symmetrical in cross-section, wherein the configuration and arrangement of materials and components is identical on each side. Double-sided symmetrical construction enables flipping of the cushion or mattress to obtain the same support characteristics on a fresh uncompressed side. It was long held that this was necessary to allow compressed layers of padding, particularly natural materials such as cotton batting or fowl feathers, to decompress while the opposite side was used as the support side. But with the advent of improved materials for the padding layers, including foam materials with excellent resilience which promptly return to an uncompressed or substantially uncompressed state, the padded support side does not require a prolonged recovery period as was provided by flipping to an performance for the life of the product. This has led to the recent development of "one-sided" mattresses, designed and constructed to have only one support permanent support side or surface, with an opposite side designed for permanent support by and contact with the top side of a box spring or foundation. One-sided or "no-flip" mattresses are thus designed to concentrate essentially all of the support and comfort features at or near the single support side, with the opposite or bottom side serving only as a platform for support by a foundation. The amount and quality of padding and other filling materials at or near the support side is therefore dramatically greater than at the opposite bottom side.

A recent trend in mattress design is the one-sided "no flip" mattresses, having only one surface or weight-bearing side. In one-sided mattresses, padding is eliminated from the bottom side an augmented on the support side. However, despite this radical change in the padding placement, the innerspring design has not been changed or designed for one-sided support performance. Instead, the construction of one-sided mattresses has continued to use conventional innersprings, which, due to their symmetrical construction resulting from the use of generally symmetrical coils as manufactured by coil production, have two sides (as defined by the coils ends)

which provide reflective support. In this respect, in a one-sided mattress made with a conventional innerspring, there is a substantial amount of wire material and structure on the bottom side of the innerspring which is excessive and not required for adequate or optimal performance of the single support surface.

Among the many design attributes of wire form innersprings, the height and stiffness of the individual coil springs are especially important. The overall height of a mattress is dictated in part by the height of the coils, and tall coils such as in the 5.5 inch-8.0 inch range are desirable for American style high profile mattresses. High height coils and innersprings present a greater engineering challenge to maintain adequate stiffness. In helical shaped coils, stiffness generally decreases with height, which is achieved by forming a greater number of helical turns of wire in the body of the coil. The smaller helical angle between the more numerous turns of the coil requires less force for compression. Although this provides a softer support structure, it can be too soft to provide adequate and long-lasting support in a one-sided mattress. Also, when the number of helical turns is increased symmetrically about the length of the coil, this adds wire at the bottom end of the coil where there is no direct load applied in a one-sided mattress. The stiffness of coils can be increased by using heavier gauge wire, but this adds significantly to weight and material costs. Therefore, simply increasing the number of coil turns in the coils of an innerspring is not a practical solution to creating a high height or high profile innerspring for use in a one-sided mattress.

A primary factor in innerspring design is material cost, namely that of steel wire. Although heavier gauge wire can be used to increase stiffness, as mentioned this increases material and handling costs. Also, heavier gauge wire induces a greater amount of wear on the wire forming equipment used to manufacture innersprings. A coil design which has adequate or augmented height and stiffness, and which is configured to have one of many weight-bearing end and which requires a lesser amount of material than conventional symmetrical coils would be desirable.

In this respect, in a one-sided mattress with a conventional innerspring, there is a substantial amount of material and structure on the bottom side of the innersprings which is excessive and not required for adequate or optimal performance. Among the many design attributes of a wire form innerspring, height and stiffness of especially important. The overall height of a mattress is dictated in part by the height of the coils, and tall coils such as in the 6.5-7.5 in range are desirable for American style tall profile mattresses. High height coils and innersprings present a greater engineering challenge to maintain adequate stiffness, which generally decreases with height as achieved by a greater number of helical trims of wire per coil.

Another factor in innerspring design is material cost, namely that of steel wire. Although heavier gauge wire can be used to increase stiffness, this of course increases the cost. Also, heavier gauge wire induces a greater amount of wear on the wire forming equipment. A coil design which has adequate height and stiffness, and which is configured to have one of many weight-bearing end and which requires a lesser amount of material than conventional symmetrical coils would be desirable.

SUMMARY OF THE INVENTION

This summary does not limit the legal scope of the patent as defined by the claims. The disclosure and invention is of different types of helical springs which have one or more non-helical segments between ends of the coil and a helical body of the coil, and innersprings made with such coils. The disclosure and invention is of different types of stepped coils, also referred to herein as "one-step" or "multi-step" coils, which are formed of wire made of steel or alloys, and have at least one non-helical segment in combination with or contiguous with a helical coil body and one or both of the coil ends. As used herein, the terms "step", "stepped", "one-step" and "multi-step" refer to and mean the non-helical shaped segments of the described coils. The disclosure and invention further includes innersprings for mattresses and other reflexive support structures which are made with the stepped coils. The step or steps may be aligned or coaxial with a longitudinal axis of the coil, or in other configurations or angles, and provide height and length to coil with less material than coils wherein the entire coil body is in the form of a helix. The non-helical configuration and orientation of the step or steps of the coils, when assembled in an innerspring, can be used to form a relatively stiff base to the coil which supports a coil body with helical turns (i.e., a helical coil body) which has a lower spring rate and softer feel for a support surface of the innerspring. The one-step and multi-step coils of the disclosure can be used in any type of innerspring which is installed in any type of product or structure which requires the reflexive support of an innerspring. The one-step or multi-step coils can be interconnected in an array by lacing wires or clips, or by fabric which partially or completely encapsulates the coils, or by any other devices or materials. The non-helical segment of segments of the coils can be linear or curvilinear, and aligned or parallel with, or not, the longitudinal axis of the helical coil body, and extend perpendicular or at other angles from the planes of the coil ends.

In one aspect of the invention, there is provided a one-step coil for use in an innerspring, the stepped coil has a generally helical coil body formed by a plurality of generally helical turns, a coil end at each axial end of the coil body, each coil end generally lying in a plane generally perpendicular to a longitudinal axis of the coil body, and a step segment contiguous with the coil body and one of the coil ends and which is generally parallel with the longitudinal axis of the coil body.

In another aspect of the invention, there is provided a stepped coil for use in an innerspring, the stepped coil having a generally helical coil body, coil ends formed at ends of the coil body, and at least one non-helical step contiguous with an end of the coil body and one of the coil ends, the step having a linear or vertical extent which spaces an end of the coil body from the respective coil end. A plurality of the wire coils can be interconnected to form an innerspring, wherein the steps of the coils are located in a common plane proximate to one side of the innerspring.

In another aspect of the invention, there is provided a stepped coil for an innerspring, the wire coil having a generally helical coil body and coil ends formed at ends of the coil body, and at least one step located between and contiguous with an end of the coil body and one of the coil ends, the step having a non-helical configuration and a linear extent which spaces the contiguous coil end from the respective end of the coil body. The step may have one or more bends between the end of the coil body and the coil end. A plurality of the coils can be interconnected with the coil ends forming parallel sides of the innerspring, and the steps of the coils located proximate to only one of the sides of the innerspring, or some of the steps of the coils located proximate to one of the sides of the innerspring, and some of the steps of the coils located proximate to the other side of the innerspring.

In another aspect of the invention, there is provided a multi-step coil, for assembly into an innerspring formed by a plurality of wire coils which are connected together, the wire coil having a generally helical coil body and coil ends at ends of the coil body, and a step formed between the ends of the coil body and each of the coil ends, the steps having a non-helical configuration and spacing the ends of the coil body from the respective coil ends. When assembled in an innerspring, the steps of the coils are located in common planes proximate to the ends of the coils which form support surfaces or sides of the innerspring.

These and other aspects of the invention are described herein with reference to exemplary embodiments which are for illustrative purposes only and do not otherwise limit the legal scope of the patent as defined by the claims and equivalents thereof.

DETAILED DESCRIPTION OF PREFERRED AND ALTERNATE EMBODIMENTS

Figure 1A:
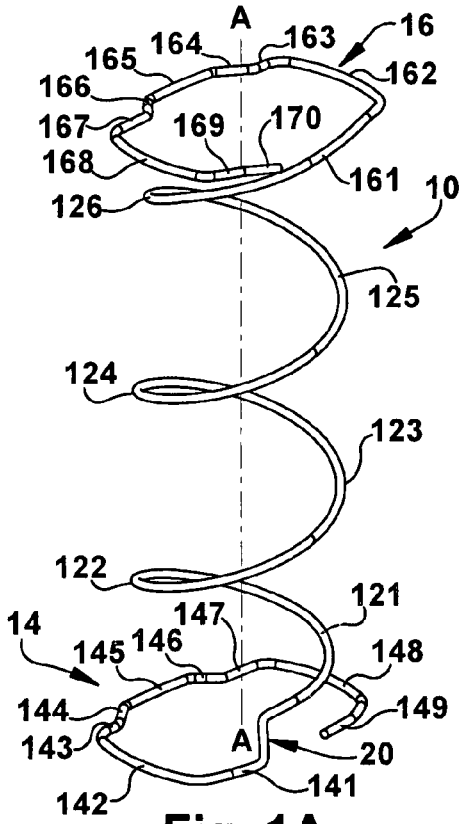
FIGS. 1A-1E are various views of a one-step coil.
Figure 1B:
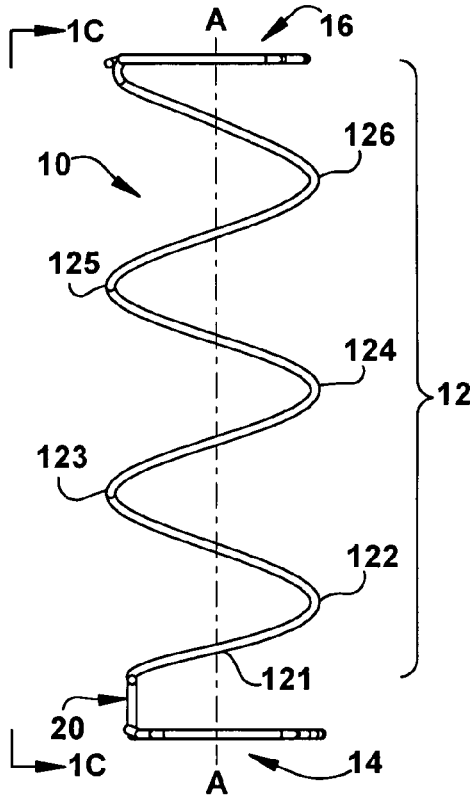
Figure 1C:
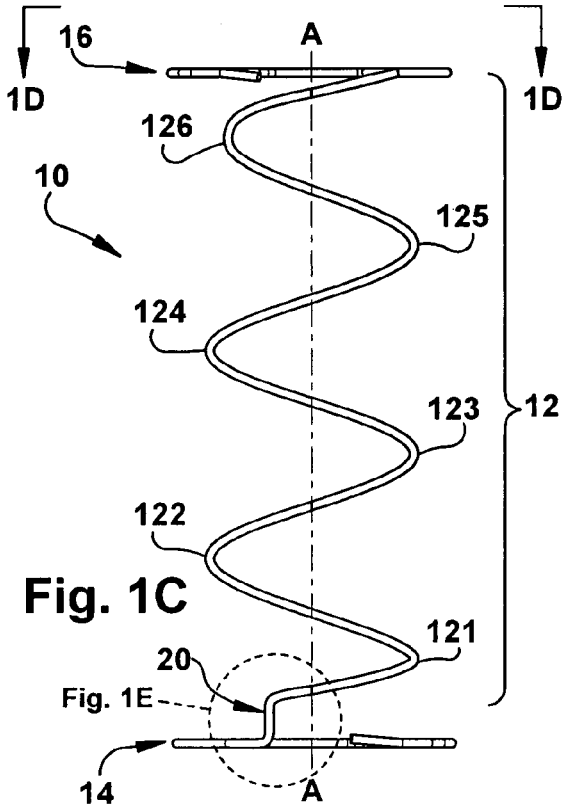
Figure 1D:
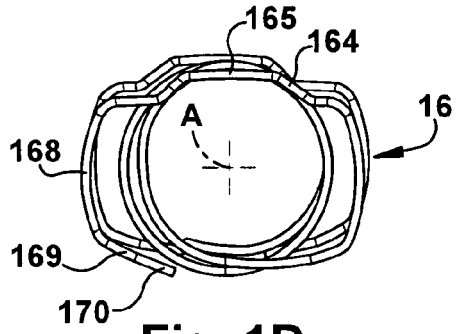

As shown in the Figures, an example of a one-step coil of this disclosure is indicated in its entirety at 10. The coil 10 has a generally cylindrical body 12 formed by a plurality of generally helical turns 121-126, coil ends 14 and 16, and a coil step 20. As will be further described, the coil step 20 in one form is generally not aligned with the generally helical form of the coil body 12, i.e., non-helical, and in some forms may be angled with respect to a longitudinal axis A of the coil, generally vertically oriented or generally aligned with or parallel to a longitudinal axis A of the cylindrical coil body 12. The coil step 20 does not follow the generally helical form or path of the helical turns 121-126 of the coil body 12. Also, the coil step 20 is not limited to being linear (i.e., straight) but may be curvilinear and have multiple curves or turns, as further described. In this particular example, the step 20 has a segment which is linear (straight) between the coil end 14 and the coil body 12, and which is generally vertically oriented and substantially parallel with the longitudinal axis A of the coil body 12. There is a lower transition 27 between the coil end 14 (segment 141) and the step 20, and an upper transition 29 between the step 20 and the first turn 121 of the coil body 12.

Regardless of the form of the coil step 20 and its orientation relative to the coil body 12, it provides the advantages of elevating or distancing the coil body from the coil end from which the step extends, resulting in coil loft or height with a lesser amount of wire material, and does not interfere with and actually enhances the spring rate and characteristics of the contiguous coil body 12. The coil step 20 has the effect of increasing the overall length of the coil 10 as measured from end-to-end, i.e., coil end 14 to coil end 16. As used herein, the term "step" generally refers to any generally linear or curvilinear segment of wire in a coil, located between the helical coil body and a coil end, which does not follow the helix or path of the helical form of the wire of the coil body, and which may have at least one segment which is generally aligned with or parallel to a longitudinal axis of the coil body, or which is co-located at a radial extent from the longitudinal axis A with an outer radial extent of one of the helical turns of the coil body. The coils 10 which have such a coil step 20 are sometimes referred to herein as "one-step coils". However, the scope of the invention is not limited to coil configurations with one and only one "step" as described herein. The helical turns 121-126 are generally designated at different elevations along the height of the coil body 12, but it is understood that the generally cylindrical coil body is formed by a continuous helical shape to the wire of the coil, no precise section of which is a discrete turn or bend in the wire. The number of coil turns may vary depending upon the design parameters of diameter and height, and the desired spring rate, which as noted generally varies inversely with the number of helical turns.

Figure 2:
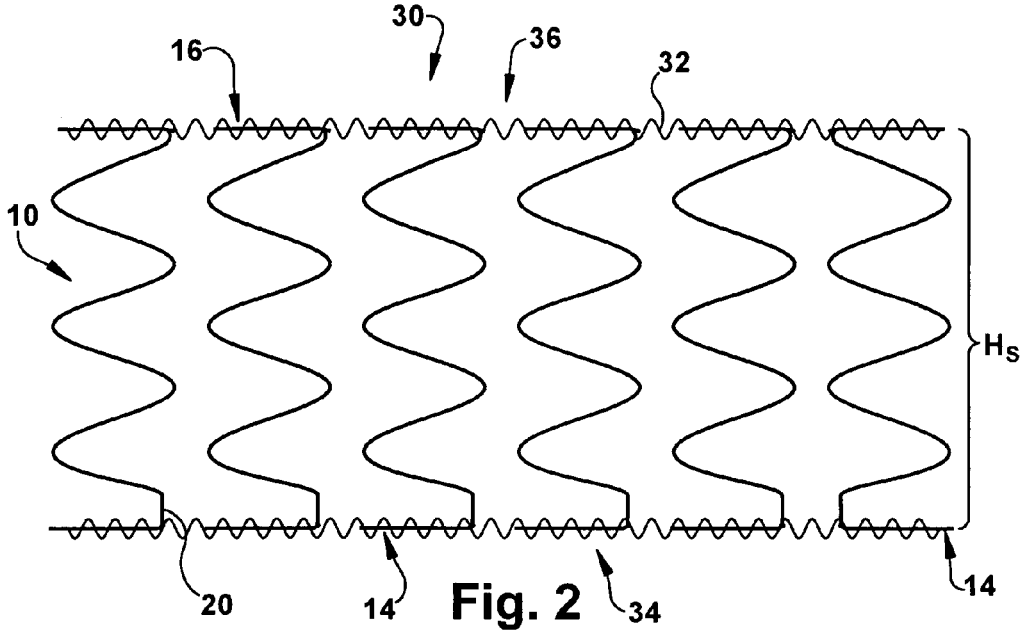
FIG. 2 is an elevation of an innerspring that includes a plurality of one-step coils.

The generally cylindrical coil body 12 has a longitudinal axis which runs the length of the coil 10 at the radial center of each of the helical turns of the coil 10. The coil body 12 is contiguous with a first coil end, generally indicated at 14, and a second coil end, generally indicated at 16. The designations "first coil end" and "second coil end" are for identification and reference only and do not otherwise define the locations or orientations of the coil ends. Accordingly, either the first coil end 14 or second coil end 16 may alternatively be referred to herein as simply a "coil end". Either of the coil ends 14 or 16 may serve as the support end of the coil in an innerspring in a one-sided or two-sided mattress. As shown in FIG. 2, each of the coils ends 14 and 16 lie generally in respective planes generally perpendicular to the longitudinal axis of the coil body 12.

As further shown in FIGS. 1A-1E, the coil ends 14 and 16 may have multiple contiguous segments, e.g. 141-149 and 161-170 respectively, which can be formed by suitably configured coil forming equipment, as described for example in the commonly assigned U.S. Pat. No. 4,726,572. Coil ends which have one or more linear segments, such as in coil ends 14 and 16, are advantageous for allowing the coils to be more closely spaced in an innerspring array than coils with circular ends, and by providing a linear path for lacing wires that run between coils. The coil ends 14 and 16 are not necessarily identically configured, and in fact one of the coil ends may be differently configured than the other. For example, one of the coil ends may have one or more additional segments, as defined by the various bends in the coil head, than the other. As shown in FIGS. 1A-1D, coil end 16 may have a segment 170 which is a slightly bent terminating segment, which does not appear in coil end 14. Additional segments, such as segment 170, can be provided to increase the weight bearing and load distribution area of the coil end and to strengthen the coil end and make it more rigid. The generally helical body 12 extends between the coil ends 14 and 16. The coil ends 14 and 16 are alternatively referred to as either "first" or "second" ends, and the step 20 can be contiguous with or proximate to either of the coil ends. As used herein with reference to the step 20 and the longitudinal axis of the coil body, the term "aligned" means parallel or coaxial.

Figure 1E:
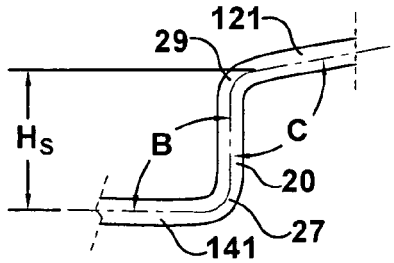

As shown in FIG. 1E, the angle C between the step 20 and the helical turn 121 is greater than 90 degrees, and in one preferred form is approximately 115 degrees, although other angles are possible. Angle B between the step 20 and coil end segment 141 is substantially 90 degrees, although other angles are possible including those greater or less than 90 degrees. Preferably, angle B is less than angle C. The linear extent of the step 20, designated $H_s$, can be any length which the type and gauge of wire can accommodate in combination with the other design parameters of the coil.

In order to increase the total height of the coil 10, as measured from one coil end to the other, a generally vertical segment 20, also referred to herein as a "step", is formed contiguous with or as part of the coil body 12, and contiguous with a coil end. In one embodiment, the generally vertical segment 20 is oriented substantially parallel to a longitudinal axis of the coil body 12 and substantially perpendicular to the respective planes of the coil ends. In other embodiments, the generally vertical segment 20 can be located at any position between the coil ends, adjacent to and contiguous with either of the coil ends, or intermediate any of the helical or other shaped turns of the coil body.

Figure 3:
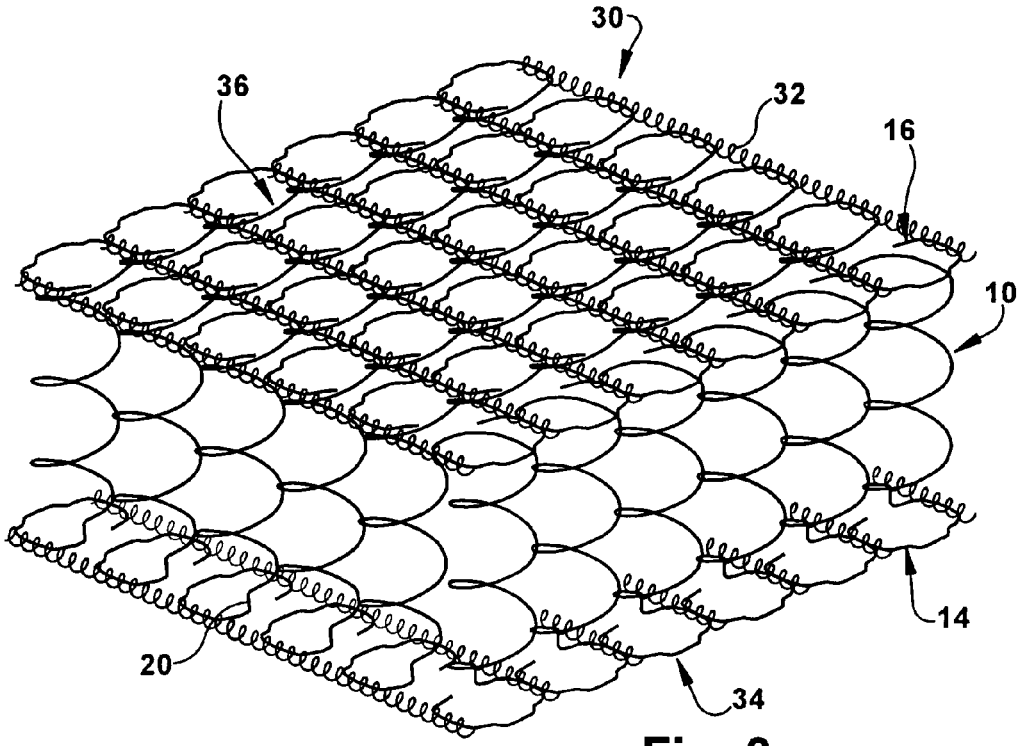
FIG. 3 is a perspective view of an innerspring that includes a plurality of one-step coils.
Figures 4A, 4B, 4C, 4D:
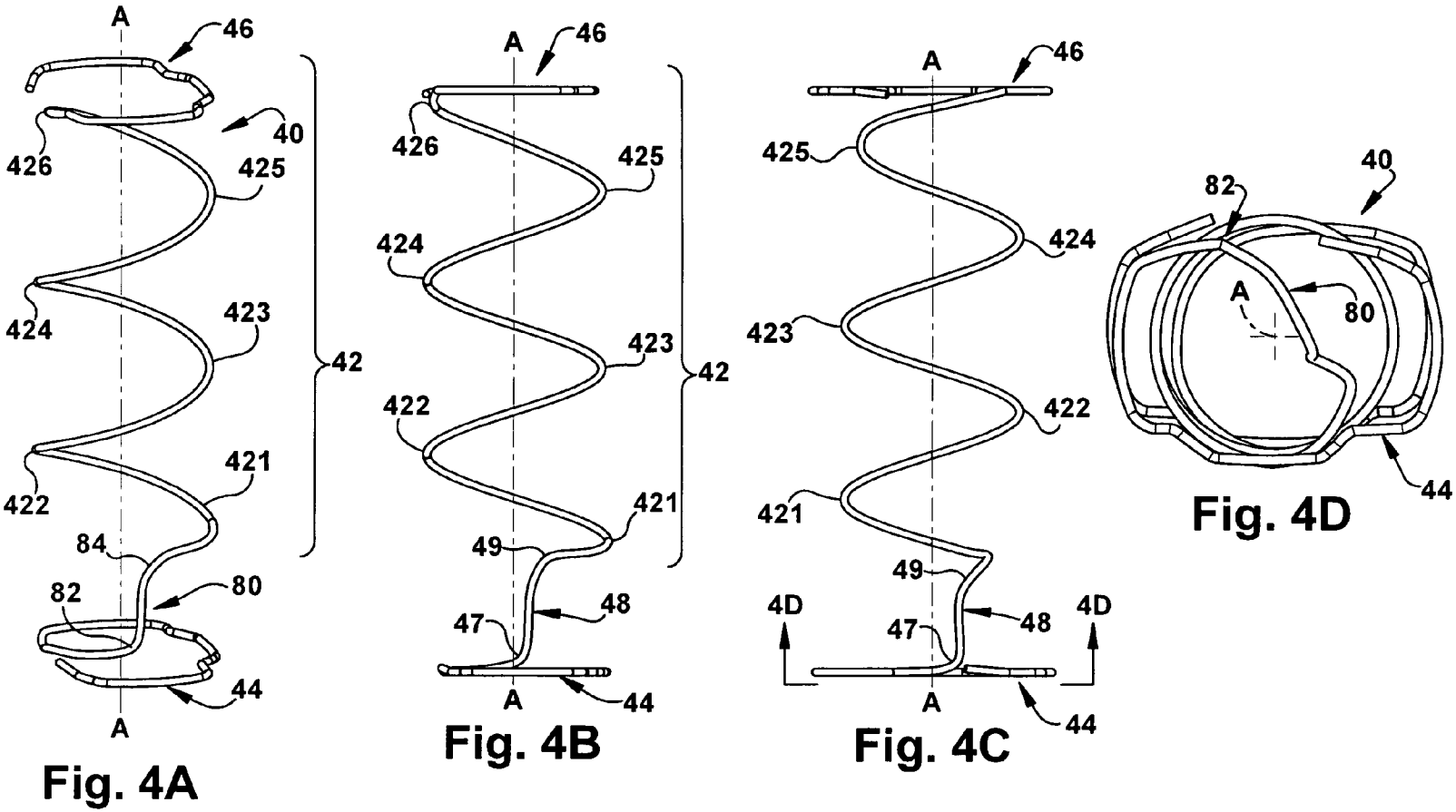
FIGS. 4A-4D are various views of an alternate embodiment of a one-step coil.

As shown in FIGS. 2 and 3, the step may be located proximate to a coil end, 14 or 16, which will serve as the bottom or base end of the coil and innerspring (opposite the upper support end of the coil and innerspring). One aspect of this configuration with the step 20 located at or near the bottom of the coil 10 is that the opposite support end of the coil has substantially the same spring rate and reflexive response and feel as a conventional helical coil which does not have a step 20. The coil end proximate to or contiguous with the step 20 may also have a similar spring rate as the upper region of the coil contiguous with the upper coil end. The spring rate or stiffness of the coil at the step 20 is of course much higher than that of the coil body 12, due in part to the generally vertical orientation of the step 20, and the fact that the step 20 is generally perpendicular to the planes in which the coil ends lie. The step 20 serves as a lift for the helical portion of the coil body 12, increasing the total height of the coil by some or all of the length of the step 20, without significantly altering the spring characteristics of the support end of the coil. The length or vertical extent of the step 20 can be varied according to the total spring and innerspring height desired and the overall spring stiffness or rate. In general, lengthening of the step 20 reduces the amount of helical form wire which will generally increase the spring rate of the coil. However, the diameter of the helical turns of the coil can be adjusted independent of the length of the step 20 as a variable to achieve both the desired height and spring rate in a coil in accordance with the invention. The wire gauge can also be selected with consideration of the step configuration and size. Wire gauge is an important design parameter with respect to the vertical and lateral loads which the step 20 must withstand. In some designs, the reduction afforded by the step 20 in the total length of wire required for each coil can be put toward heavier gauge wire.

FIGS. 2 and 3 illustrate an innerspring 30, such as for use in a mattress, seating, furniture or in any reflexive support structure, including a one-sided mattress. The innerspring 30 includes a plurality of one-step coils 10 which are arranged in a matrix or array such as in linear rows and columns and a rectangular boundary. Adjacent rows of coils are interconnected by lacing wires 32 which wrap helically around adjacent segments of coil ends 14, 16, along the length of the innerspring 30. With each of the one-step coils 10 commonly orientated in the innerspring 30, coil ends 14 lie generally in a common plane which defines a base plane or surface 34 to the innerspring 30, and coil ends 16 lie generally in a common plane which defines a support surface 36 to the innerspring 30. The innerspring 30 so constructed with the one-step coils 10 having the step 20 located proximate to coil ends 14 defining the base surface of the innerspring, increases the total height $H_i$ of the innerspring 30 by the extent of the step 20, and positions the most reflexive helical portion of the coils proximate to the support surface 36. This achieves the benefits of greater innerspring height which results in greater mattress height, the use of less wire material in each of the coils 10, and no degradation or stiffening of the spring rate of the coils and innerspring as perceived at the support surface 36.

FIGS. 4A-4D illustrate an alternate embodiment one-step coil, indicated generally at 40, which includes a step 48 which as shown is generally aligned with the longitudinal axis of the coil body 42. Preferably, the step 48 is located substantially at or aligned with the longitudinal axis of the coil body 42. In this particular example, the step 48 is contiguous with a transition segment 47 which extends from one of the coil ends (such as coil end 44) toward the axis A of the coil 40, to thereby position the step 48 substantially aligned or parallel with or at the longitudinal axis A of the coil 40. By extending from the transition segment 47 which may be formed substantially within the plane of the coil end 44, a lower end of the step 48 is closely contiguous with coil end 44 which forms the base or bottom of an innerspring 40. As further shown in the Figures, a distal end of the transition segment 47 generally rises above the plane in which the coil end 44 resides. The transition segment 47 can be considered part of the coil end 44, or as a separate segment between the coil end 44 and the step 48. With this configuration, the transition segment 47 functions as a cantilevered displacement type spring which is deflected at its distal end when an axial load is placed upon the step 48 from the superior coil body 42. Also, because the step 48 is positioned at or near the longitudinal axis A of the coil, the overall spring rate of the coil is increased in the region of the step 48 due to the minimal amount of compression associated with the step 48. The step 48 is a generally vertically oriented segment of wire of a length in an approximate range of 0.125 inches to 1.25 inches (or 1 mm to 40 mm or longer), resulting in a substantial increase in overall height of the coil 40 without the wire otherwise required to achieve such height with additional helical turns. The lineal extent range of the step 48 is exemplary only, and it is possible to configure the coil 40 with a step 48 of shorter or longer lengths.

Although the step 48 and transition segment 47 is described in connection with coil end 44, it is understood that the same arrangement can alternatively be formed with the other coil end 46, or with the step 48 (with or without the transition segment 47) formed at both coil ends 44 and 46. The length of the step 48 is limited only by the bending action of the wire with a generally axial load upon the step 48, and the type and gauge of wire material used. The transition segment 47 between the step 48 and the coil body 42 also provides flexure between the coil body 42 and the step 48 in addition to the compression of the coil body 42 and deflection of the step 48 in response to loads. The step 48 can be formed in connection with coil ends 44, 46 of any configuration, including those which have the generally linear segments as described with reference to coil 10 for lacing in an innerspring as previously described.

Figure 5:
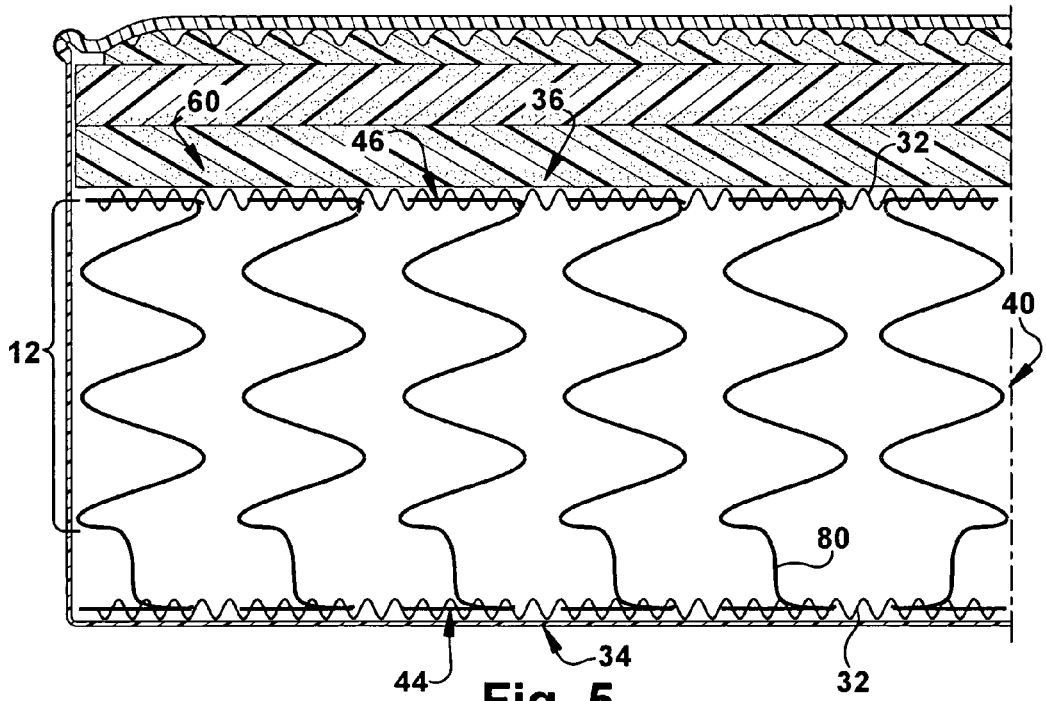
FIG. 5 is an elevation of an innerspring that includes a plurality of one-step coils of an alternate embodiment.
Figure 6:
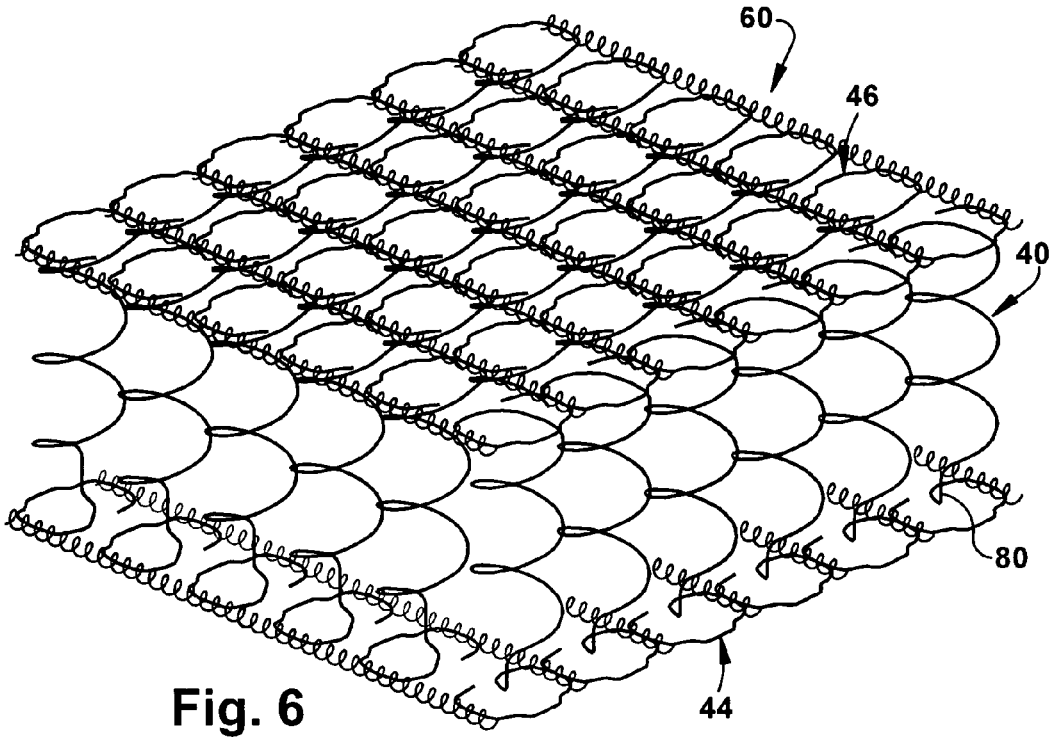
FIG. 6 is a perspective view of an innerspring that includes a plurality of one-step coils of an alternate embodiment.

FIGS. 5 and 6 illustrate an innerspring assembly 60 ("innerspring") constructed with a plurality of the previously described one-step coils 40 by interconnection of the proximate coil ends 44, 46 by lacing wires 32. In the coils 40 of FIG. 5, the step 48 is generally curvilinear along at least some segment between the corresponding coil end 44 and the coil body 12. Any of the described one-step coils can be interconnected in this or a similar manner to form an innerspring. Because the step 48 extends out of the plane in which the coil end 44 lies, it is positioned away from and does not interfere with the segment of the coil ends 44 which is engaged by the lacing wires 32 and interconnection of the coils 40 into an innerspring assembly 60.

Figure 7A:
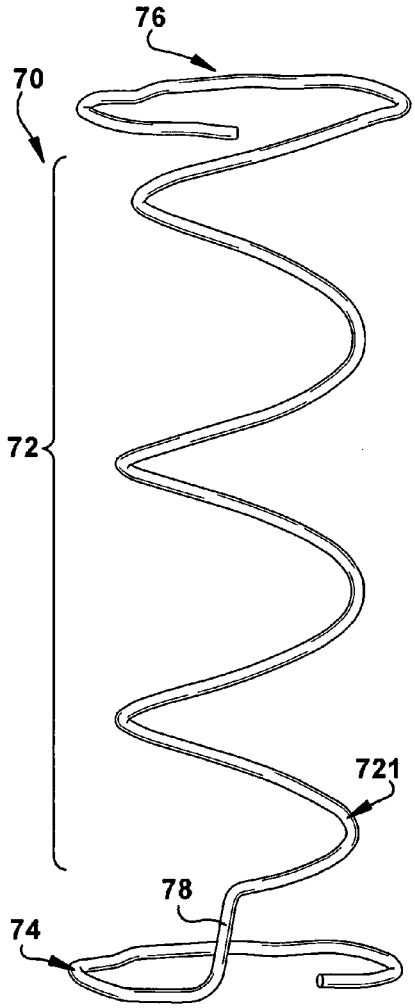
FIGS. 7A-7C are elevations of an alternate embodiment of a one-step coil, referred to herein as a "slant forward" type one-step coil.
Figure 7B:
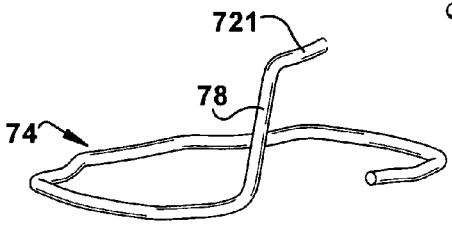
Figure 7C:
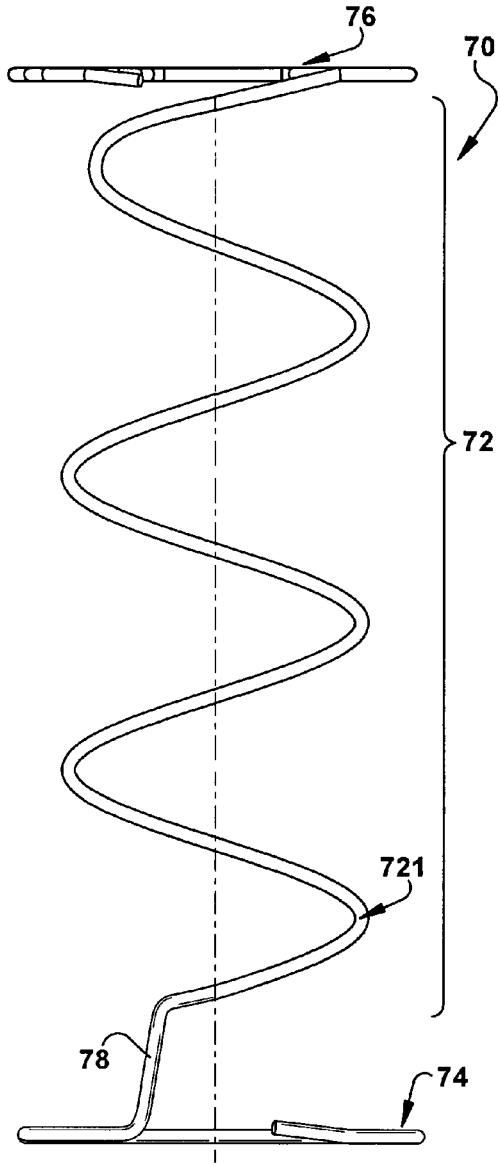

FIGS. 7A-7C illustrate an alternate embodiment of a one-step coil of the invention, indicated generally at 70, which has a slant forward step 78 which extends from the coil end 74, i.e., out of the plane in which the coil end 74 lies, to a first turn 721 of a helical coil body 72. An opposite coil end 76 is formed at an opposite end of the coil body 72. The slant forward step 78 is oriented at an angle with respect to the plane in which the coil end 74 lies, and intersects the first turn 721 of the helical coil body 72 at an obtuse angle. That is, the angle formed by the intersection of the step 78 and the first turn 721 of the helical coil body 72 is greater than ninety degrees. The slant forward step 78 extends from the coil end 74 at an obtuse angle, i.e., the step 78 extends from the plane in which the coil end 74 lies at an obtuse angle. The step 78 is the only non-helical form of wire between the coil end 74 and 76.

Figure 8A:
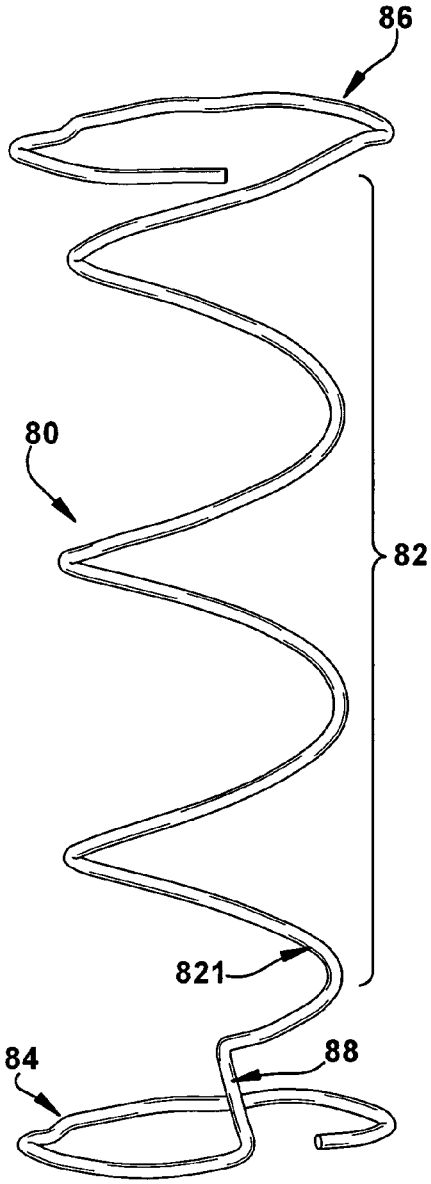
FIGS. 8A-8C are elevations of an alternate embodiment of a one-step coil, referred to herein as a "slant backward" type one-step coil.
Figure 8B:
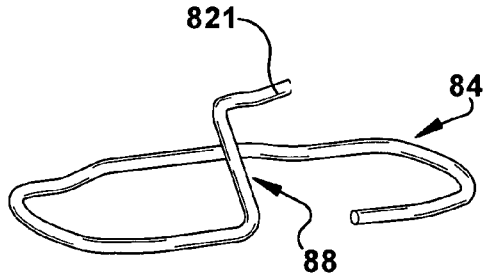
Figure 8C:
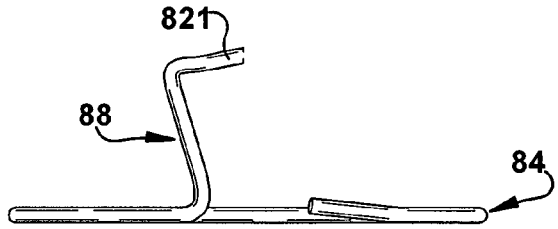

FIGS. 8A-8C illustrate an alternate embodiment of a one-step coil of the invention, indicated generally at 80, which has a slant backward step 88 which extends from the coil end 84 to a first turn 821 of a helical coil body 82. The slant backward step 88 is oriented at an angle with respect to the plane in which the coil end 84 lies, and intersects the first turn 821 of the helical coil body 82 at an acute angle. That is, the angle formed by the intersection of the step 88 and the first turn 821 is less than ninety degrees. The slant backward step 88 extends from the coil end 84 at an acute angle, i.e., the step 88 extends from the plane in which the coil end 84 lies at an acute angle. The step 88 is the only non-helical and straight segment of wire located between the coil ends 84 and 86.

Figure 9A:
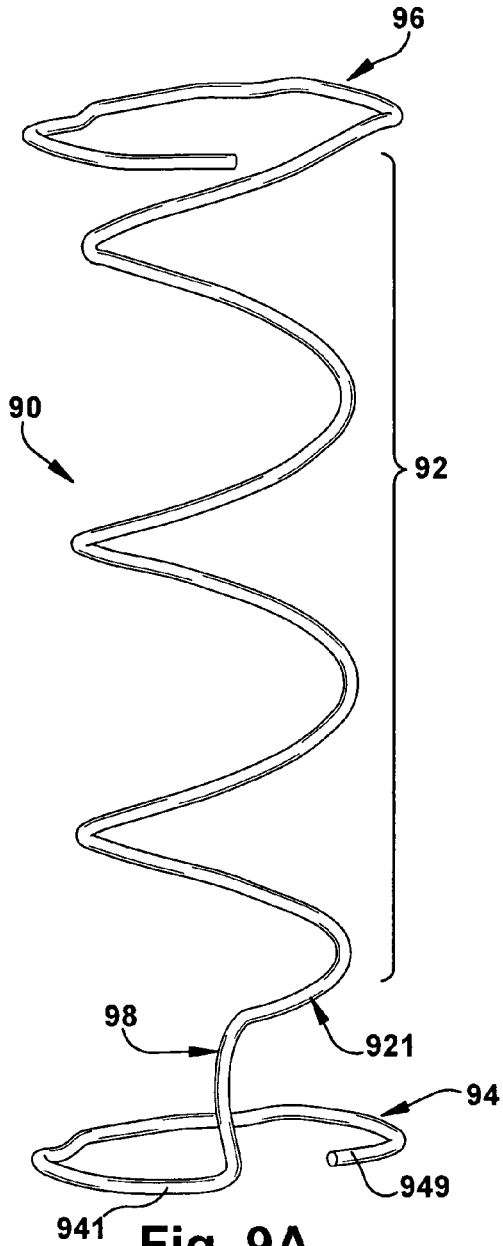
FIGS. 9A-9C are elevations of an alternate embodiment of a one-step coil, referred to herein as a "concave" type one-step coil.
Figure 9B:
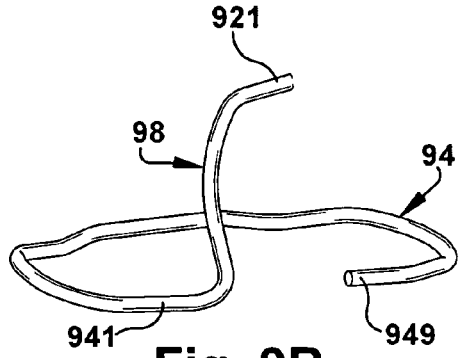
Figure 9C:
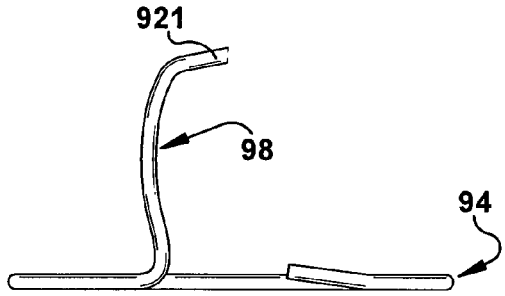

FIGS. 9A-9C illustrate an alternate embodiment of a one-step coil of the invention, indicated generally at 90, which has a concave step 98 which extends from the coil end 94 to a first turn 921 of a helical coil body 92. The concave step 98 extends out of the plane in which the coil end 94 lies, to the first turn 921. The concave step 98 is curved, with an inside form of the curve facing a terminal end 949 of the coil end 94, and an outside form of the curve facing segment 941 of the coil end 94. Although the step 98 is curved and concave in form, it is has a generally vertical orientation with respect to the coil end 94 and is generally aligned with a vertical axis of the coil 90, and with the outer perimeter of the coil end 94. Also, the angle of intersection of the step 98 with the first turn 921 is less than the angle of intersection of the step 98 with the coil end 94. This configuration allows the step 98 to provide some spring action in combination with the coil body 92. The step 98 is the only non-helical segment of wire located between the coil ends 94 and 96.

Figure 10A:
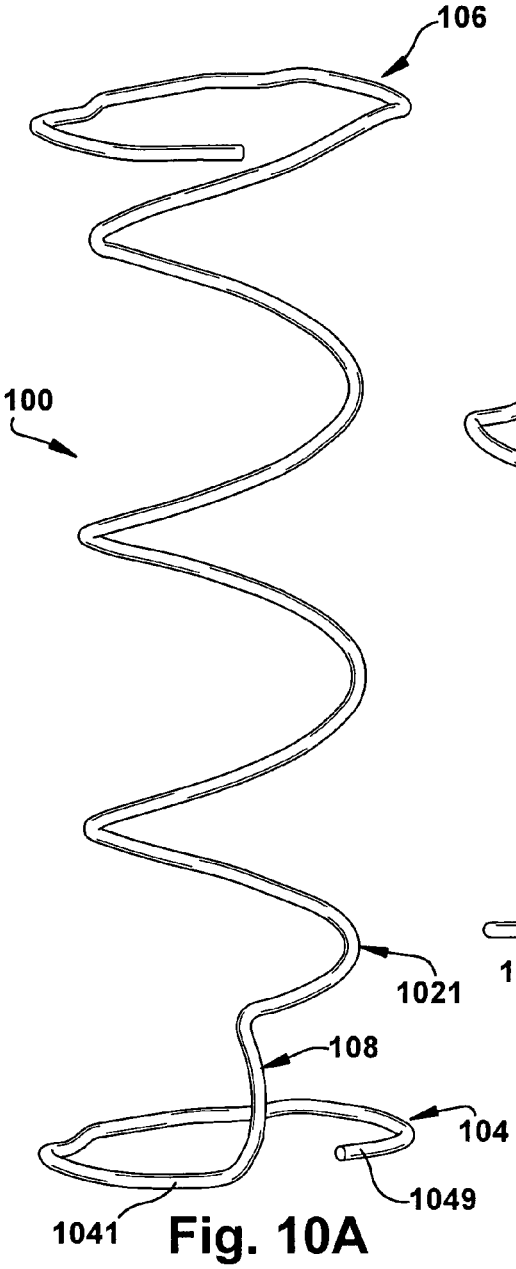
FIGS. 10A-10C are elevations of an alternate embodiment of a one-step coil, referred to herein as a "convex" type one-step coil.
Figure 10B:
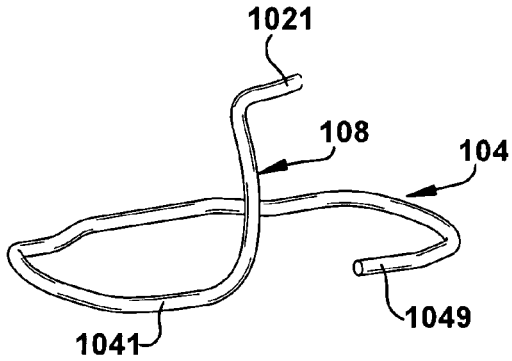
Figure 10C:
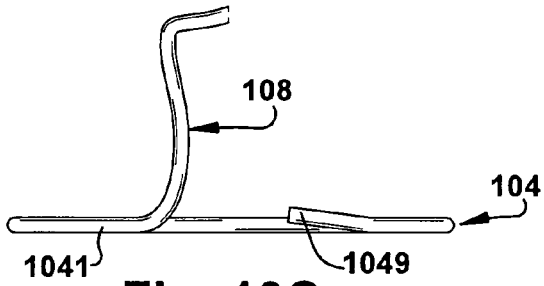

FIGS. 10A-10C illustrate an alternate embodiment of a one-step coil of the invention, indicated generally at 100, which has a convex step 108 which extends from the coil end 104 to a first turn 1021 of a helical coil body 102. The convex step 108 extends out of the plane in which the coil end 104 lies, to the first turn 1021. The convex step 108 is curved, with an outside form of the curve facing a terminal end 1049 of the coil end 94, and an inside form of the curve facing segment 1041 of the coil end 104. Although the step 108 is curved and convex in form, it is has a generally vertical orientation with respect to the coil end 104 and is generally aligned with a vertical axis of the coil 100. Although the step 108 is curved and convex in form, it is has a generally vertical orientation with respect to the coil end 104 and is generally aligned with a vertical axis of the coil 100 and with the outer perimeter of the coil end 104. Also, the angle of intersection of the step 108 with the coil end 104 is greater than the angle of intersection of the step 108 with the coil end 104 first turn 1021. This configuration allows the step 108 to provide some spring action in combination with the coil body 92 and coil ends 104 and 106, while performing the other function of elevating the coil body 102 along its longitudinal axis by the generally vertical orientation of the step 108. The step 108 is the only non-helical segment of the coil 100 between the coil ends 104 and 106.

Figure 11A:
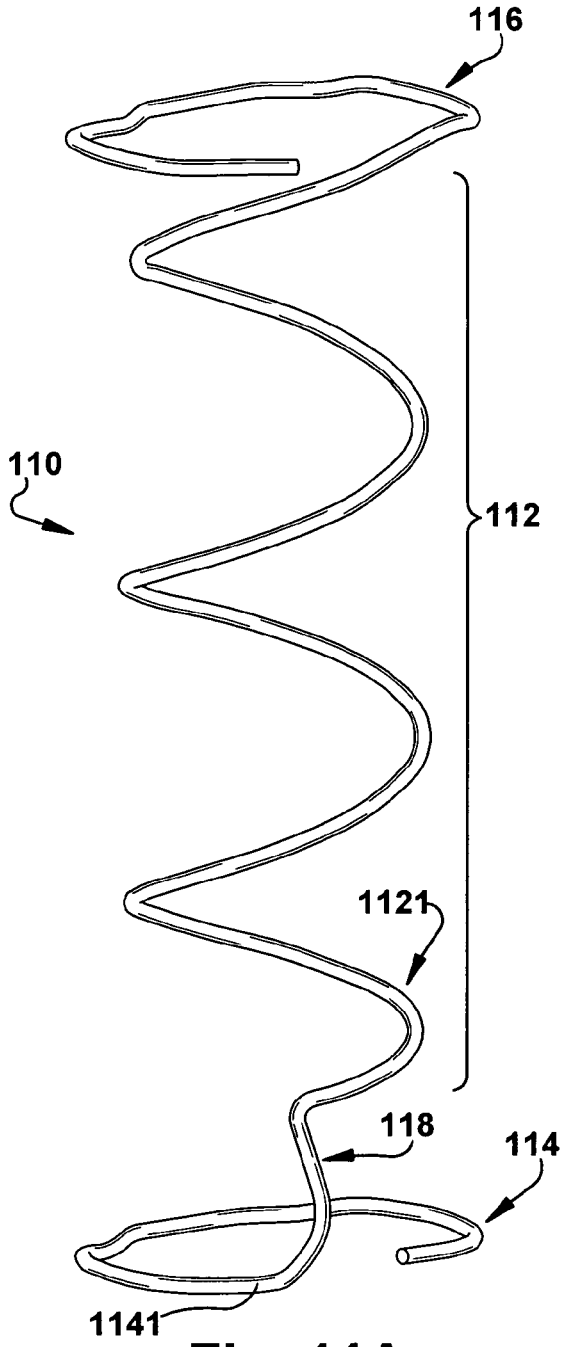
FIGS. 11A-11C are elevations of an alternate embodiment of a one-step coil, referred to herein as a "cast" type one-step coil.
Figure 11B:
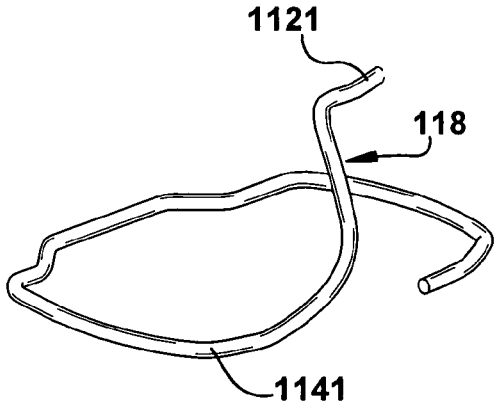
Figure 11C:
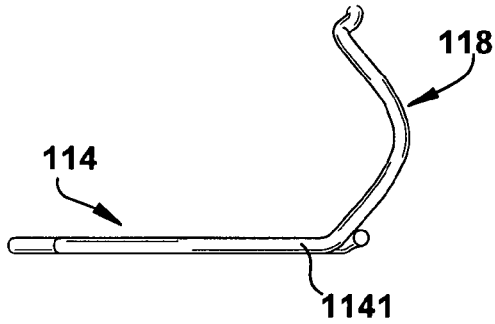

FIGS. 11A-11C illustrate an alternate embodiment of a one-step coil of the invention, indicated generally at 110, which has a cast step 118 which extends from the coil end 114 to a first turn 1121 of a helical coil body 112. The cast step 118 extends out of the plane in which the coil end 114 lies, to the first turn 1121. The cast step 118 is curved outward from the coil end 114, away from the longitudinal axis of the coil 110, and beyond the perimeter of the coil end 114, as best seen in FIGS. 11B and 11C. An inside form of the curve faces the coil 110. Although the step 118 is curved in form, it is has a generally vertical orientation with respect to the coil end 114 and can be formed generally within a vertical plane. The angle of intersection of the step 118 with the coil end 114 is approximately ninety degrees, so that the segment of the first turn 1121 which intersects with the step 118, and the segment 1141 of the coil end 114 which intersects with the step 118 each act as torsion springs in combination with the spring action of the step 118 and the coil body 112. Also, the outward curve of the step 118 with respect to the coil body 112 provides a leaf spring type mount to the entire coil body 112 between the coil ends 114 and 116. In this sense, the one step coil 110 is a hybrid spring which includes a helical spring, coil body 112, and a leaf spring, step 118. The step 118 is the only non-helical segment of the coil 110 between the coil ends 114 and 116.

Figure 12A:
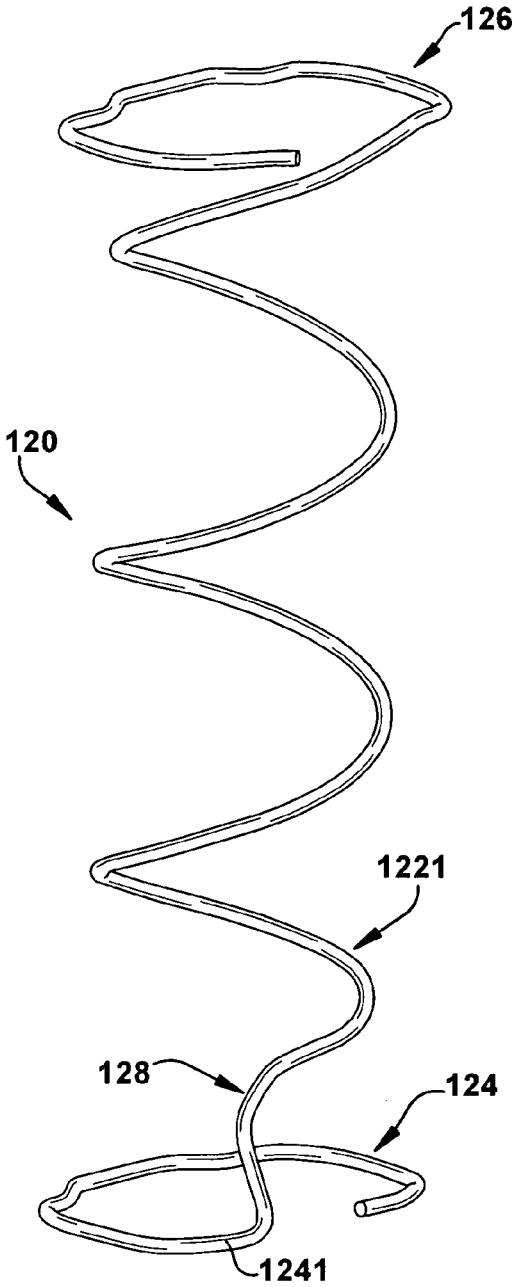
FIGS. 12A-12C are elevations of an alternate embodiment of a one-step coil, referred to herein as an "inverse cast" type one-step coil.
Figure 12B:
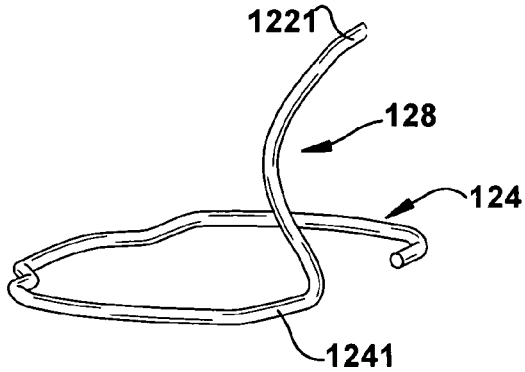
Figure 12C:
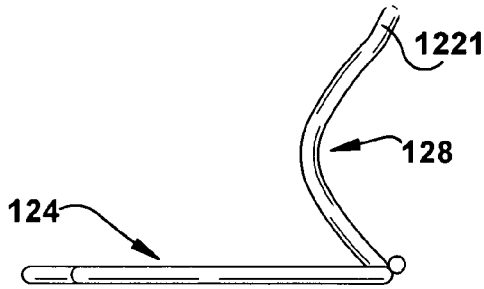

FIGS. 12A-12C illustrate an alternate embodiment of a one-step coil of the invention, indicated generally at 120, which has an inverse cast step 128 which extends from the coil end 124 to a first turn 1221 of a helical coil body 122. The cast step 128 extends out of the plane in which the coil end 124 lies, to the first turn 1221. The cast step 128 is curved inward from the coil end 124, away from the longitudinal axis of the coil 120, and within the perimeter of the coil end 124, as best seen in FIGS. 12B and 12C. An outside form of the curve is located within the helical coil body 122. Although the step 128 is curved in form, it is has a generally vertical orientation with respect to the coil end 124 and can be formed generally within a vertical plane. The intersection of the step 128 with the coil body 122 is very gradual, e.g. at an angle greater than ninety degrees, to promote flexure of the coil body 122 and step 128 in concert. The step 128 intersect the coil end 124 generally orthogonal to segment 1241 of coil end 124, whereby segment 1241 functions as a torsion spring in addition to the spring action of the step 128 and the coil body 122. Also, the inward curve of the step 128 with respect to the coil body 112 provides a leaf spring type mount to the entire coil body 122. In this sense, the one step coil 120 is a hybrid spring which includes a helical spring, coil body 122 (and coil ends 124 and 126), and a leaf spring, step 128. The step 128 is the only non-helical segment of the coil 120 between the coil ends 124 and 126.

Figure 13A:
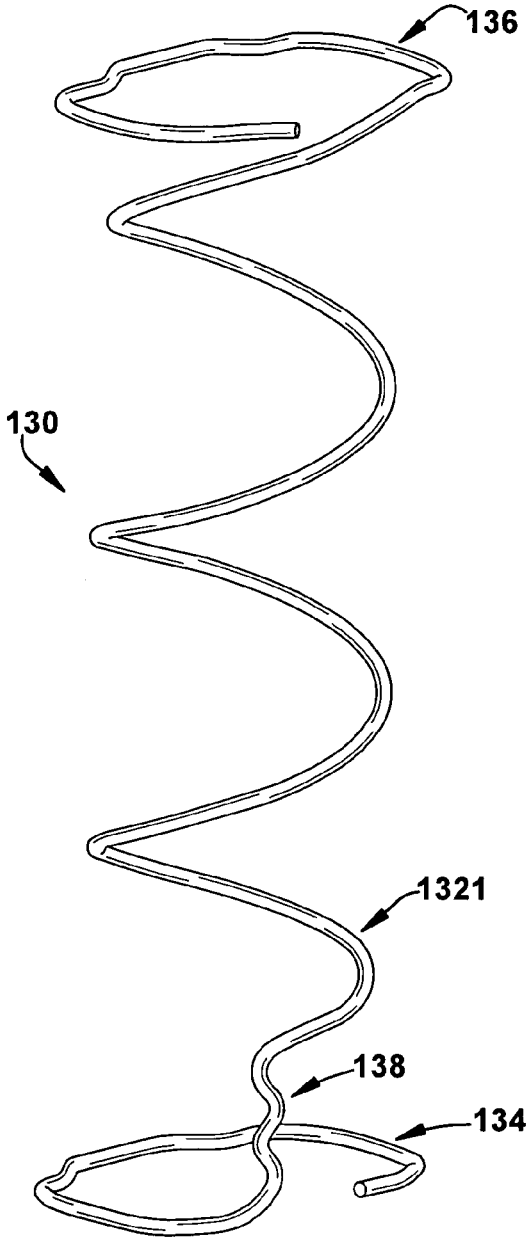
FIGS. 13A-13B are elevations of an alternate embodiment of a one-step coil, referred to herein as a "wave" type one-step coil.
Figure 13B:
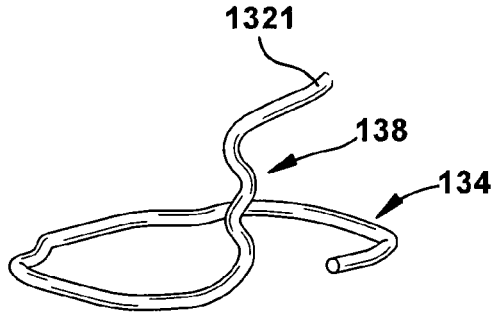
Figure 13C:
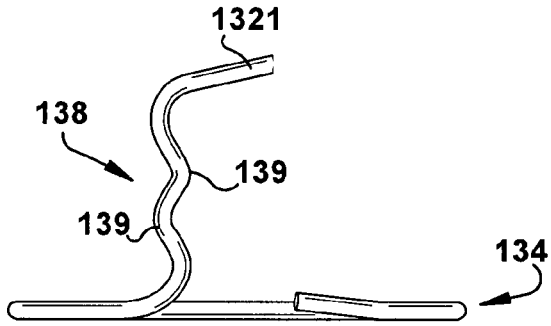

FIGS. 13A-13C illustrate an alternate embodiment of a one-step coil of the invention, indicated generally at 130, which has a wave step 138 which extends from the coil end 134 to a first turn 1321 of a helical coil body 132. The wave step 138 extends out of the plane in which the coil end 134 lies, to the first turn 1321. The wave step 138 has two or more bends or undulations 139 located between the coil end 134 and the first turn 1321 of the coil body 132. The transition angle between the wave step 138 and the coil body 132 is approximately the same as between the wave step 138 and the coil end 134. The undulations 139 lie in a vertically oriented plane, and may be aligned with the outer perimeter of the coil end 134 as shown, or orthogonal to the intersecting segment 1341 of the coil end 134. The spring rate of the wave step 138 is higher than the spring rate of the helical coil body 132. The wave step 138 therefore provides a spring action which is distinct from but in concert with the helical coil body 132 (and coil ends 134 and 136) when placed under a load. The step 138 is the only non-helical segment of the coil 130 between the coil ends 134 and 136.

Figure 14A:
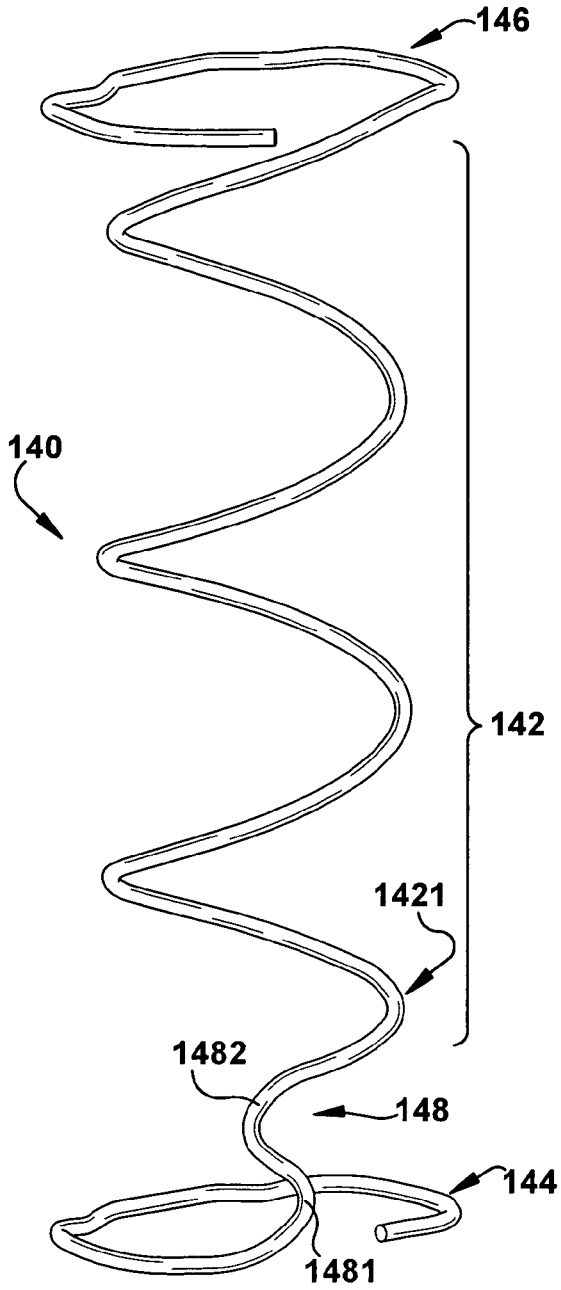
FIGS. 14A-14C are elevations of an alternate embodiment of a one-step coil, referred to herein as an "S-step" type one-step coil.
Figure 14B:
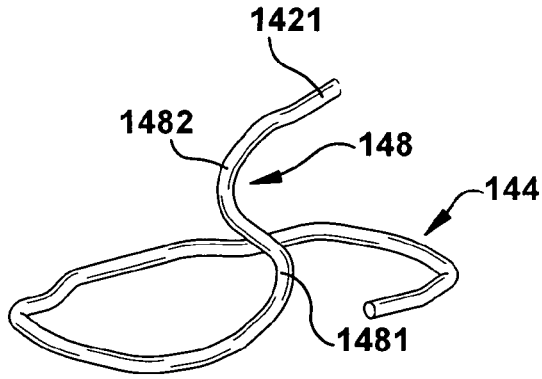
Figure 14C:
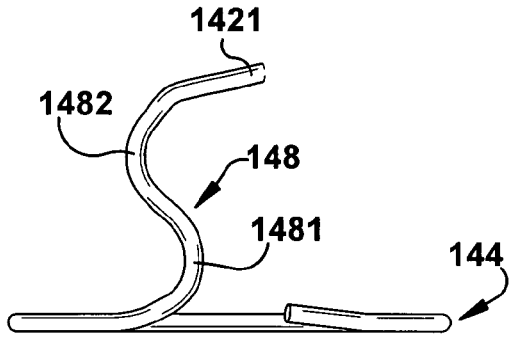

FIGS. 14A-14C illustrate an alternate embodiment of a one-step coil of the invention, indicated generally at 140, which has an S step 148 which extends from the coil end 144 to a first turn 1421 of a helical coil body 142. The S step 148 extends out of the plane in which the coil end 144 lies, to the first turn 1421 of the coil body 142, which terminates at opposite coil end 146. The S step 148 has two major bends or undulations 1481 and 1482 located between the coil end 144 and the first turn 1421 of the coil body 142. The transition angle between the S step 148 and the coil body 142 is approximately the same as between the S step 148 and the coil end 144. The two bends 1481 and 1482 lie in a vertically oriented plane, and may be aligned with the outer perimeter of the coil end 144 as shown, or orthogonal to the intersecting segment 1441 of the coil end 144 or at other angles of relative orientation. The S step 148 provides a spring action which is distinct from but in concert with the helical body 142 when placed under a load. In this sense, the coil 140 is a hybrid spring with two different spring rates which operate in concert, with the spring rate of the helical body 142 being less than the spring rate of the S step 148. The step 148 is the only non-helical segment of the coil 140 between the coil ends 144 and 146.

Figure 15A:
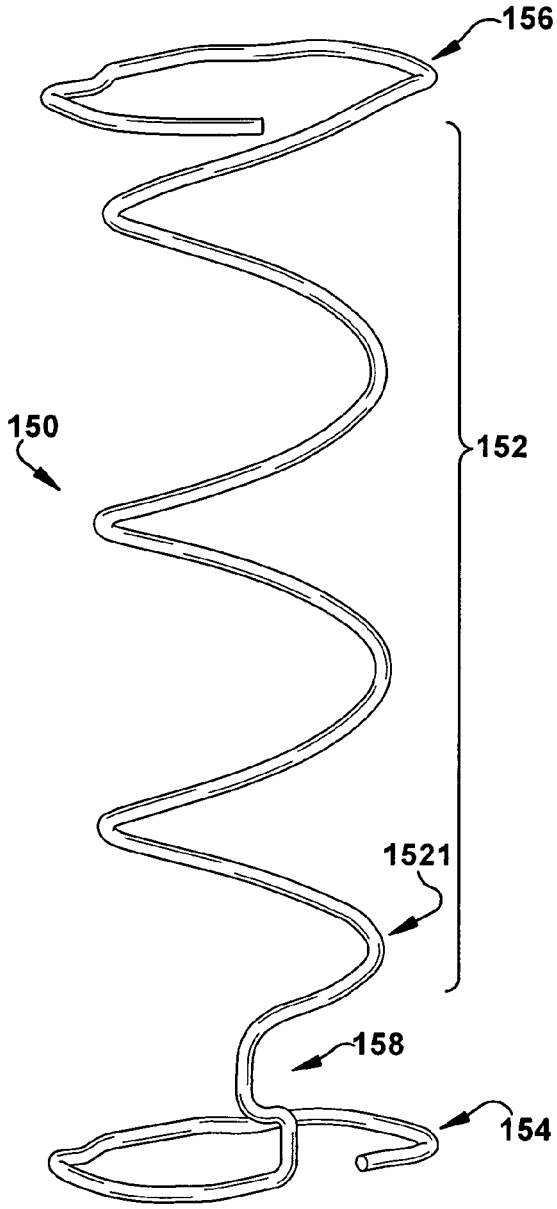
FIGS. 15A-15C are elevations of an alternate embodiment of a one-step coil, referred to herein as an "offset" type one-step coil.
Figure 15B:
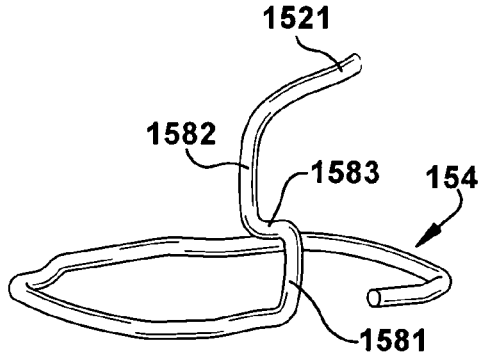
Figure 15C:
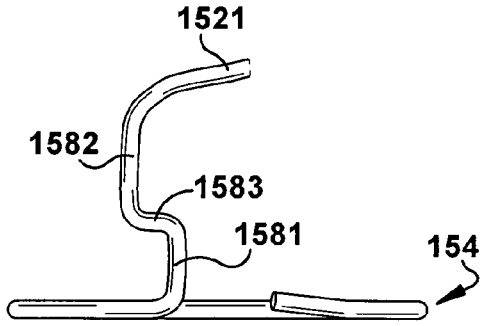

FIGS. 15A-15C illustrate an alternate embodiment of a one-step coil of the invention, indicated generally at 150, which has an offset step 158 which extends from the coil end 154 to a first turn 1521 of a helical coil body 152. The offset step 158 extends out of the plane in which the coil end 154 lies, to the first turn 1521 of the coil body 152. The offset step 158 has two major generally vertically oriented legs 1581 and 1582 which are connected through substantially ninety degree bends to an intermediate orthogonal segment 1583. When the coil 150 is placed under compression, the intermediate segment 1583 functions as a torsional spring together with or in addition to the spring action of the helical coil body 152, and as a cantilevered spring. Also, the upper vertical leg 1581 intersects with the first turn 1521 of the coil body 152 at an angle greater than ninety degrees. This is also the intersection where the entire coil body 152 is cantilever mounted in essence to the upper end of the vertical leg 1581 of the offset set 158. The step 158 is the only non-helical segment of the coil 150 between the coil ends 154 and 156.

Figure 16A:
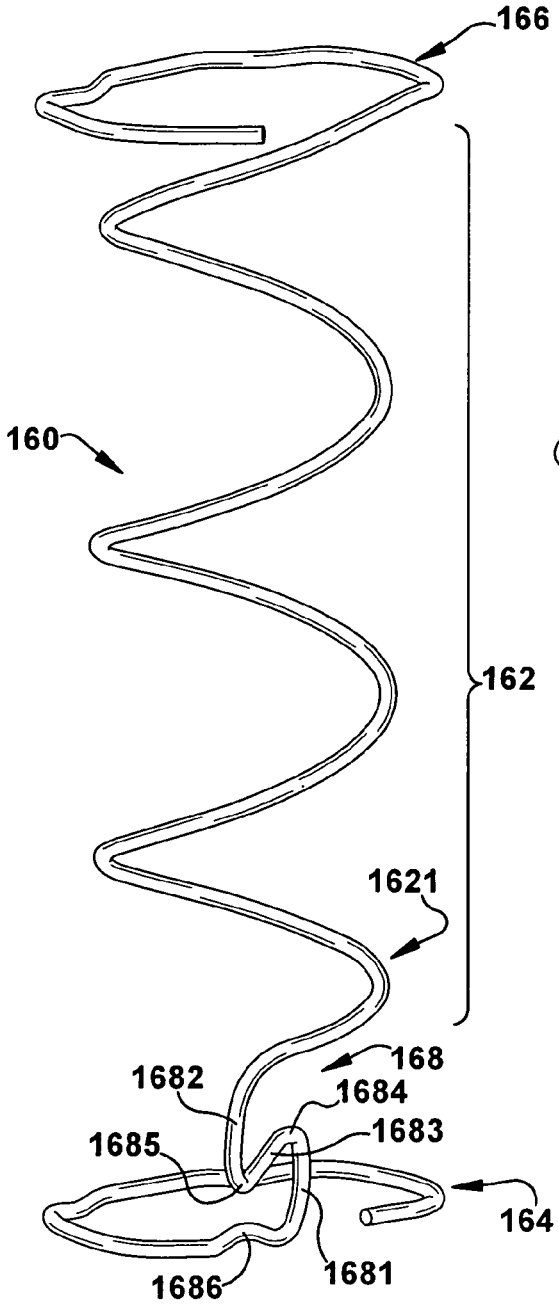
FIGS. 16A-16C are elevations of an alternate embodiment of a one-step coil, referred to herein as an "offset curve step" type one-step coil.
Figure 16B:
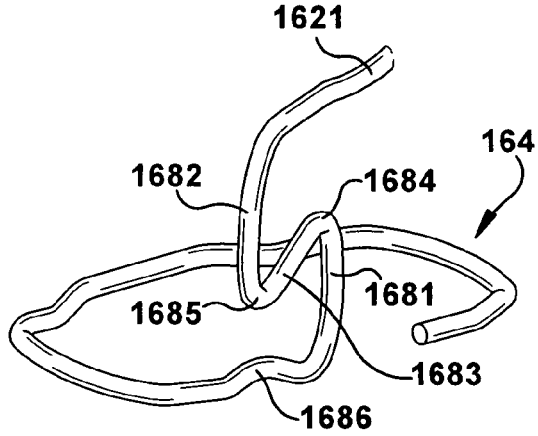
Figure 16C:
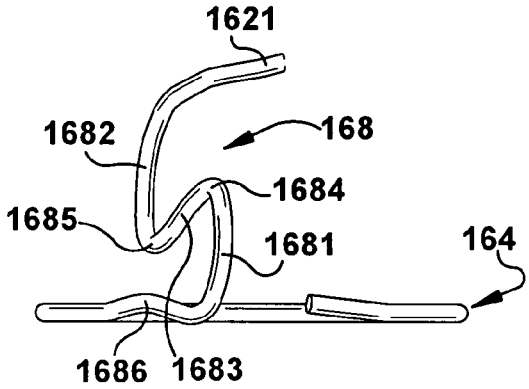

FIGS. 16A-16C illustrate an alternate embodiment of a one-step coil of the invention, indicated generally at 160, which has an offset curve step 168 which extends from the coil end 164 to a first turn 1621 of a helical coil body 162. The offset curve step 168 extends out of the plane in which the coil end 164 lies, to the first turn 1621 of the coil body 162. The offset step 168 has two major generally vertically oriented legs 1681 and 1682 which are connected by an intermediate segment 1693 which is not orthogonal to legs 1681 and 1682, by virtue of radiused bends 1684 and 1685 which are greater than ninety degrees. When the coil 160 is placed under compression, the intermediate segment 1683 functions as a leaf spring together with or in addition to the spring action of the helical coil body 162. The radiused bends 1684 and 1685 promote flexure of the offset step 168 as a separate spring element with a distinct rate within the coil 160 as a whole. The spring rate of the offset step 168 is greater than the spring rate of the coil body 162. In this sense, the coil 160 is a hybrid coil, including a helical portion (coil body 162) and a vertically oriented portion (step 168). Also, the upper vertical leg 1682 of the offset step 168 intersects with the first turn 1621 of the coil body 162 at an angle greater than ninety degrees. This is also the intersection where the entire coil body 162 is cantilever mounted in essence to the upper end of the vertical leg 1682 of the step 168. An additional bend 1686 can be formed in the coil end 164 proximate to the lower leg 1681 of the step 168 which further enhances the spring characteristics of the step 168 and coil as a whole. The step 168 is the only non-helical segment of the coil 160 between the coil ends 164 and 166.

Figure 17:
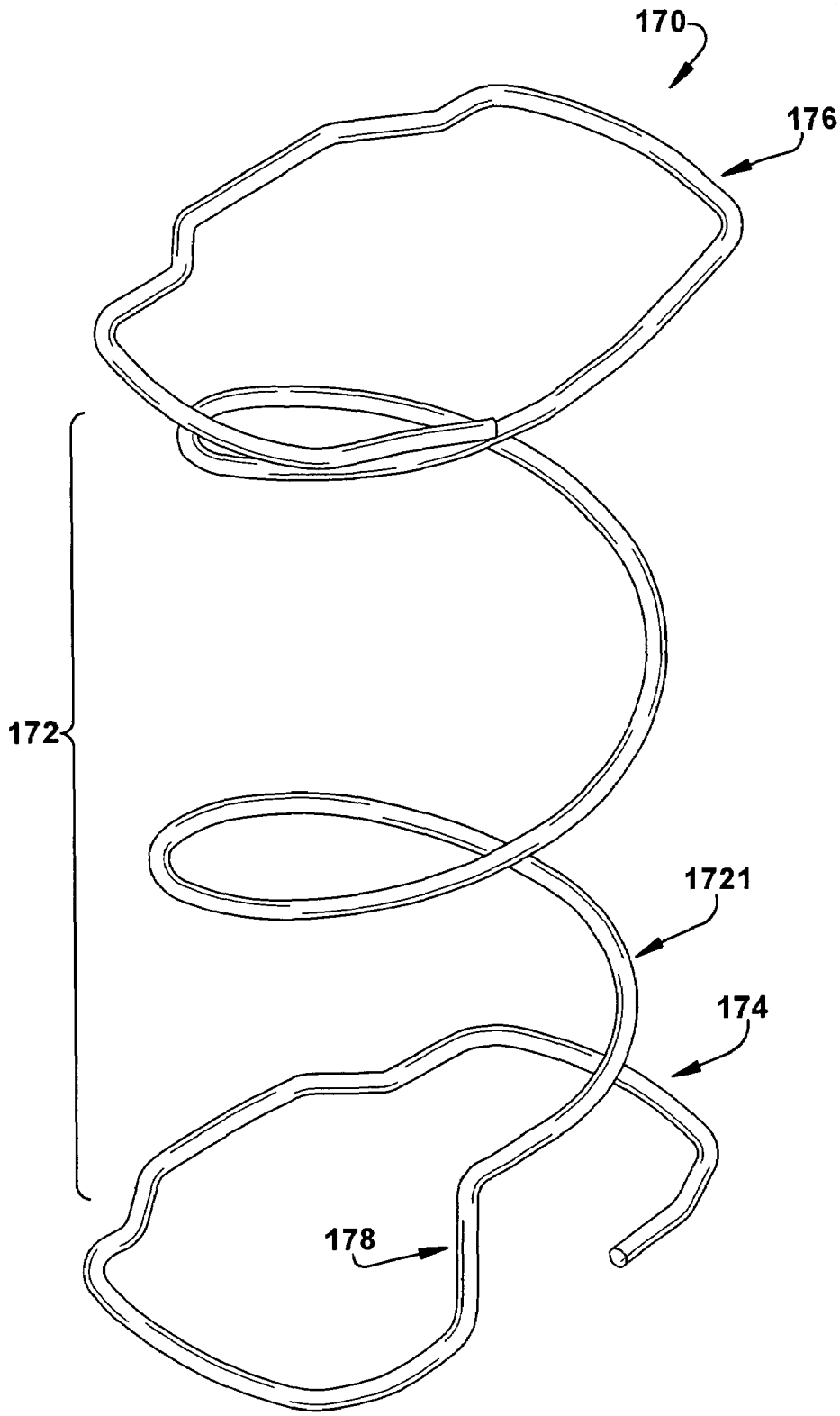
FIG. 17 is a perspective view of a four turn crib type one-step coil.

FIG. 17 illustrates an alternate embodiment of a one-step coil of the invention, indicated generally at 170, which has a single step 178 which extends from the coil end 174 to a first turn 1721 of a helical coil body 172. The single step 178 extends substantially vertically out of the plane in which the coil end 174 lies, to the first turn 1721 of the coil body 172. The intersections of the single step 178 with the first turn 1721 of the coil body 172 and the coil end 174 are approximately ninety degree bends. The total number of turns of the coil in this example is four, with the single step 178 located between the first and second, or third and fourth turns, and between the coil ends 174 and 176. The resultant short vertical extent of the coil is suitable for use in crib mattress innerspring. Also, because the anticipated loads on a crib mattress are quite small, the minimal resilience provided by the single step 178 with its vertical orientation does not significantly diminish the support characteristics of the coil or innerspring assembled with such coils. The step 178 is the only non-helical segment of the coil 170 between the coil ends 174 and 176.

Figure 18:
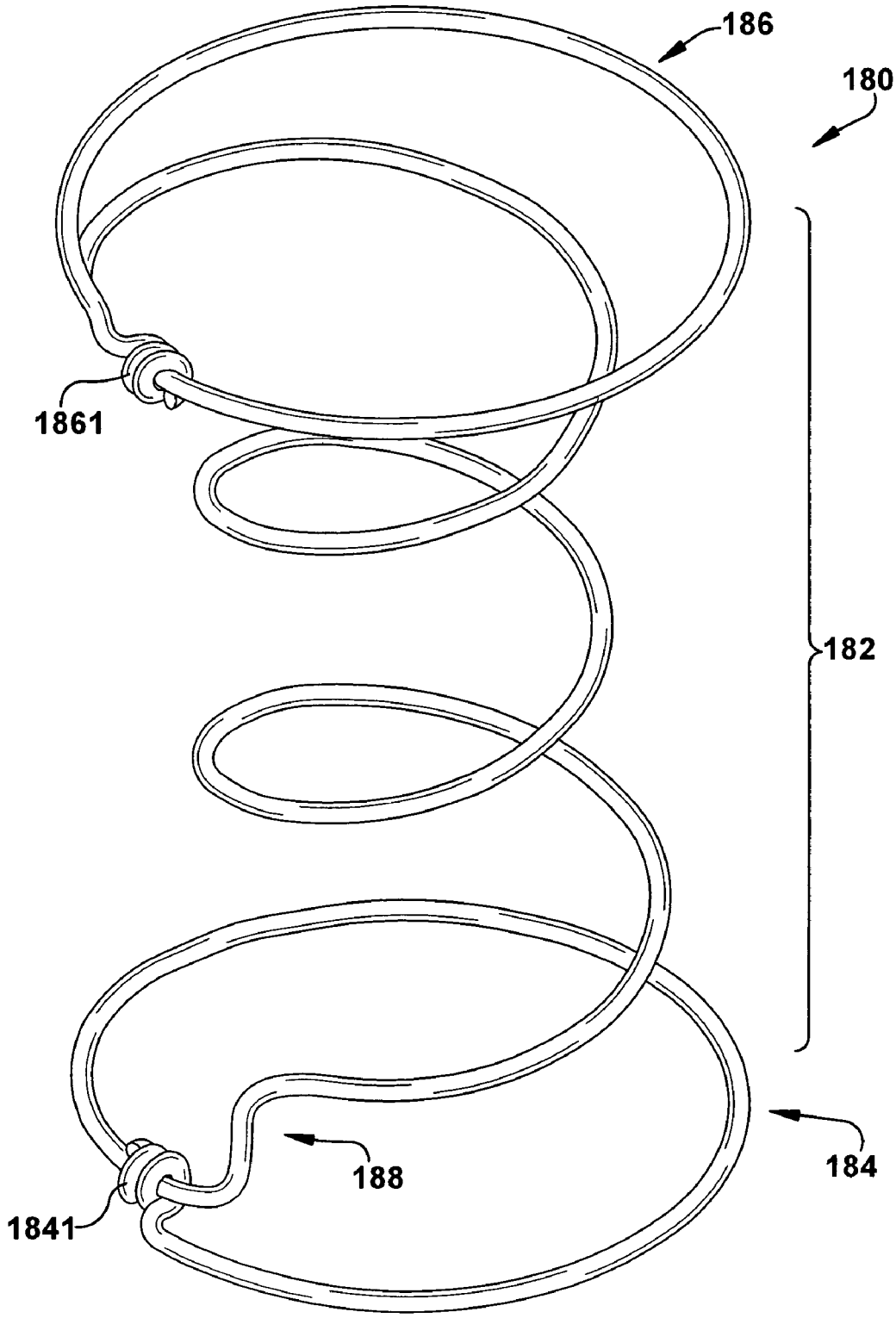
FIG. 18 is a perspective view of a Bonnel type one-step coil.

FIG. 18 illustrates an alternate embodiment of a one-step coil of the invention, indicated generally at 180, which is a Bonnel type helical coil, which has a helical coil body 182 and coil ends 184 and 186 which follow the arc of the helix of the coil body 182 but with a greater radius than the coil body 182. The terminal wire ends of the coil ends 184 and 186 are tied together at knots 1841 and 1861. A generally vertically oriented step 188 is formed between coil end 184 and the coil body 182, with approximate ninety degree bends at the intersection of the step 188 with the coil end 184 and coil body 182. The step 188 can be aligned with the perimeter of the coil end 184. The proximity of the step 188 to the termination knot 1841 is a structural integration feature which prevents sliding of the knot 1841 past the step 188. The step 188 is the only non-helical segment of the coil 180 between the coil ends 184 and 186.

Figure 19:
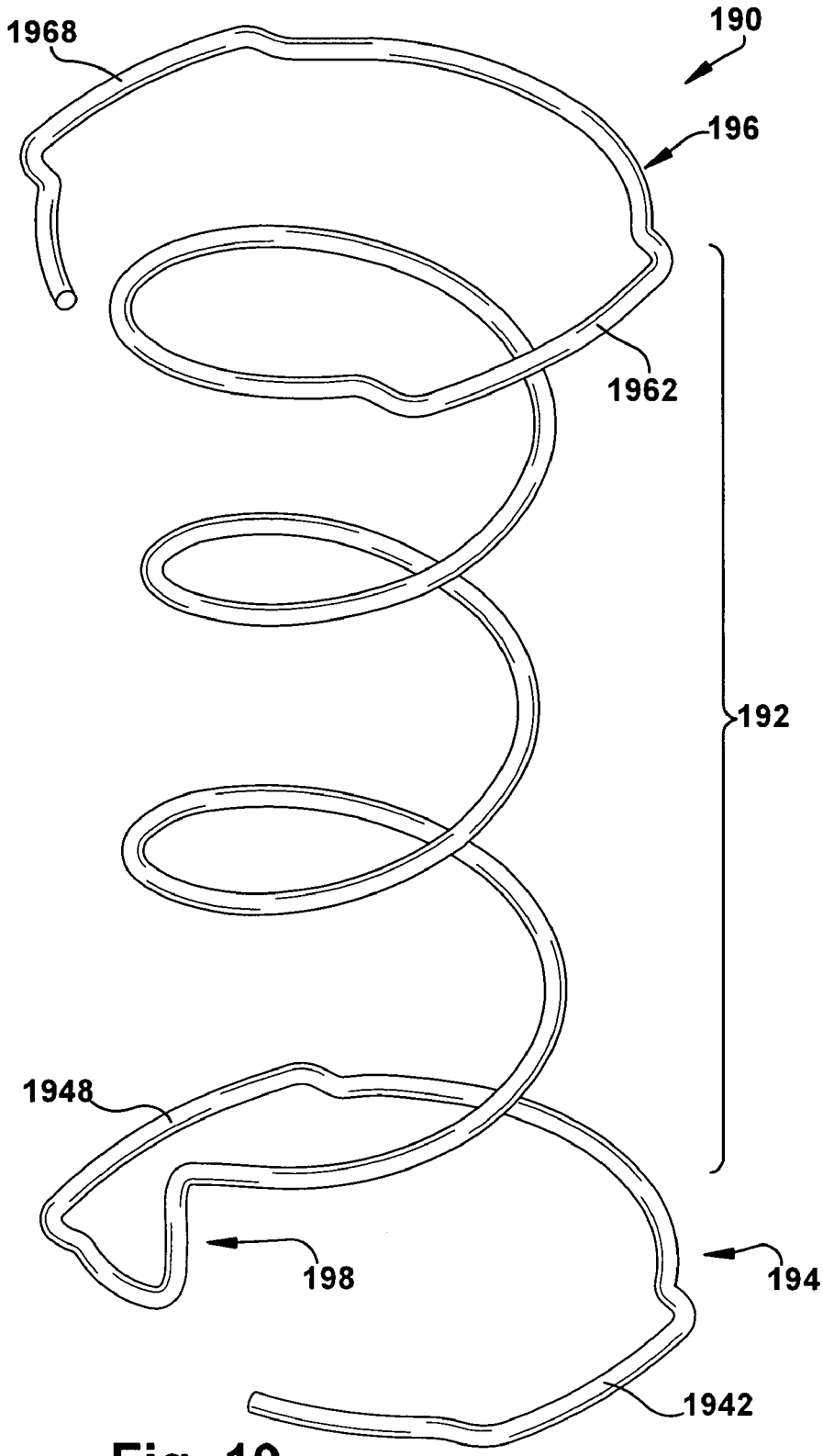
FIG. 19 is a perspective view of a one-step coil with a helical coil body and double offset ends.

FIG. 19 illustrates an alternate embodiment of a one-step coil of the invention, indicated generally at 190, which has a helical coil body 192, coil ends 194 and 196 located at opposite terminal ends of the coil body 192, and a step 198 located by between one of the coil ends (as shown coil end 194) and the coil body. The step 198 is generally vertically oriented, parallel to a longitudinal axis of the coil body 192, and located at an outer perimeter of the coil end 194. The intersection of the step 198 with the coil end 194 and a first turn 1921 of the coil body 192 is formed with bends of approximately ninety degrees or greater. The coil ends 194 and 196 are formed with offsets 1942, 1948, 1962 and 1968, which are configured for engagement by lacing wires in an innerspring assembly. The step 198 is thus located between lacing wires in an innerspring. Although the step 198 is generally vertically oriented, it nonetheless provides some degree of spring-action deflection under load, which operates with spring deflection of the helical coil body 192, thus providing a hybrid spring of helical and non-helical configuration. The step 198 is the only non-helical segment of the coil 190 between the coil ends 194 and 196.

Figure 20:
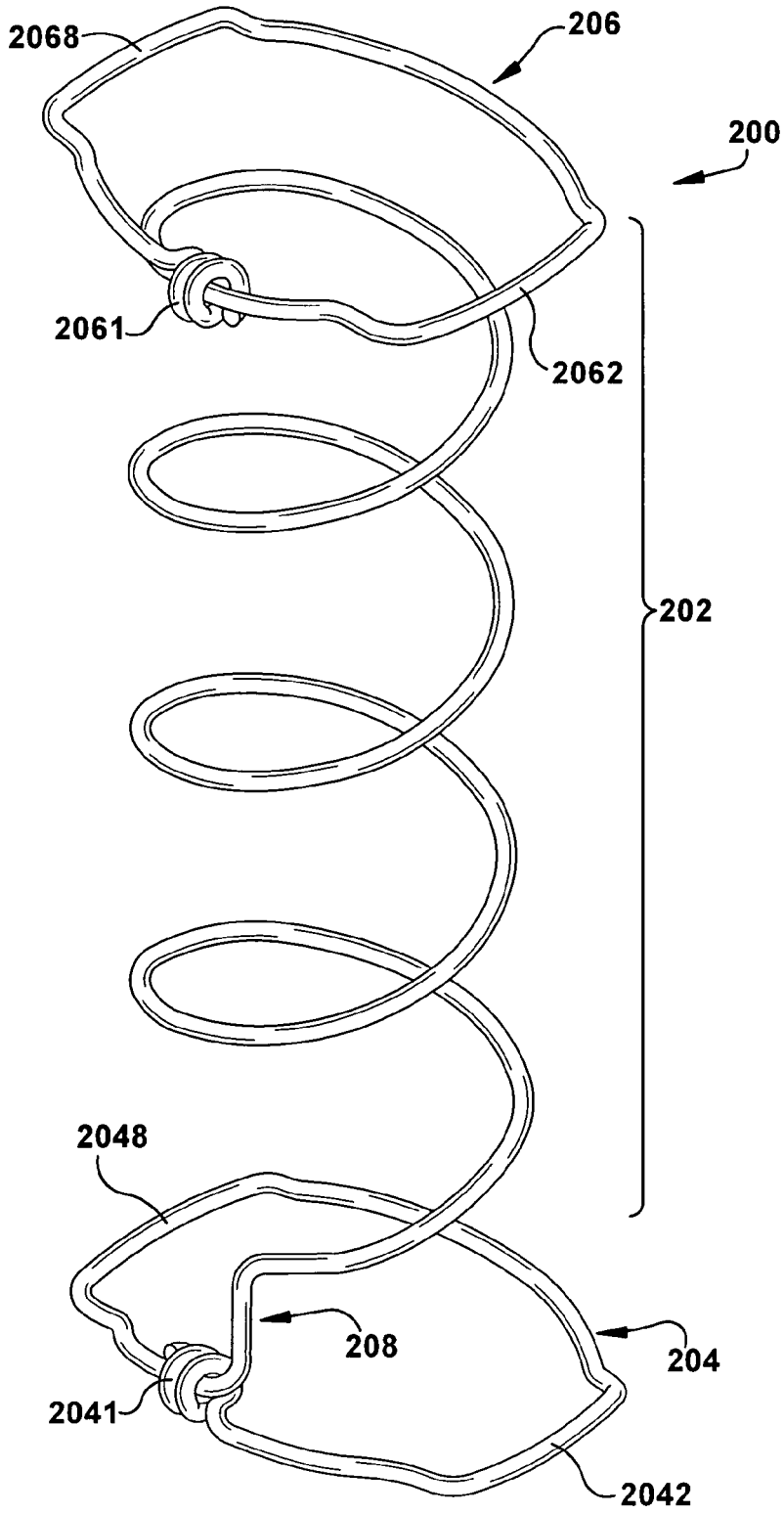
FIG. 20 is a perspective view of a one-step coil.

FIG. 20 illustrates an alternate embodiment of a one-step coil of the invention, indicated generally at 200, which has a helical coil body 202, coil ends 204 and 206 located at opposite terminal ends of the coil body 202, and a step 208 located by between one of the coil ends (as shown coil end 204) and the coil body. The step 208 is generally vertically oriented, parallel to a longitudinal axis of the coil body 202, and located at an outer perimeter of the coil end 204. The intersection of the step 208 with the coil end 204 and a first turn 2021 of the coil body 202 is formed with bends of approximately ninety degrees or greater. The coil ends 204 and 206 are formed with offsets 2042, 2048, 2062 and 2068, which are configured for engagement by lacing wires in an innerspring assembly. The step 208 is thus located between lacing wires with the coil 200 as installed in an innerspring. Although the step 208 is generally vertically oriented, it nonetheless provides some degree of spring-action deflection under load, which operates with spring deflection of the helical coil body 202, thus providing a hybrid spring of helical and non-helical configuration. The terminal wire ends at coil ends 204 and 206 are tied by knots 2041 and 2061. The greater number of turns in the helical coil body 202 combined with the vertical step 208 provides a very high profile coil which can be as high as 7.5 inches are higher as measure from coil end 204 to coil end 206. The step 208 is the only non-helical segment of the coil 200 located between the coil ends 204 and 206.

Figure 21A:
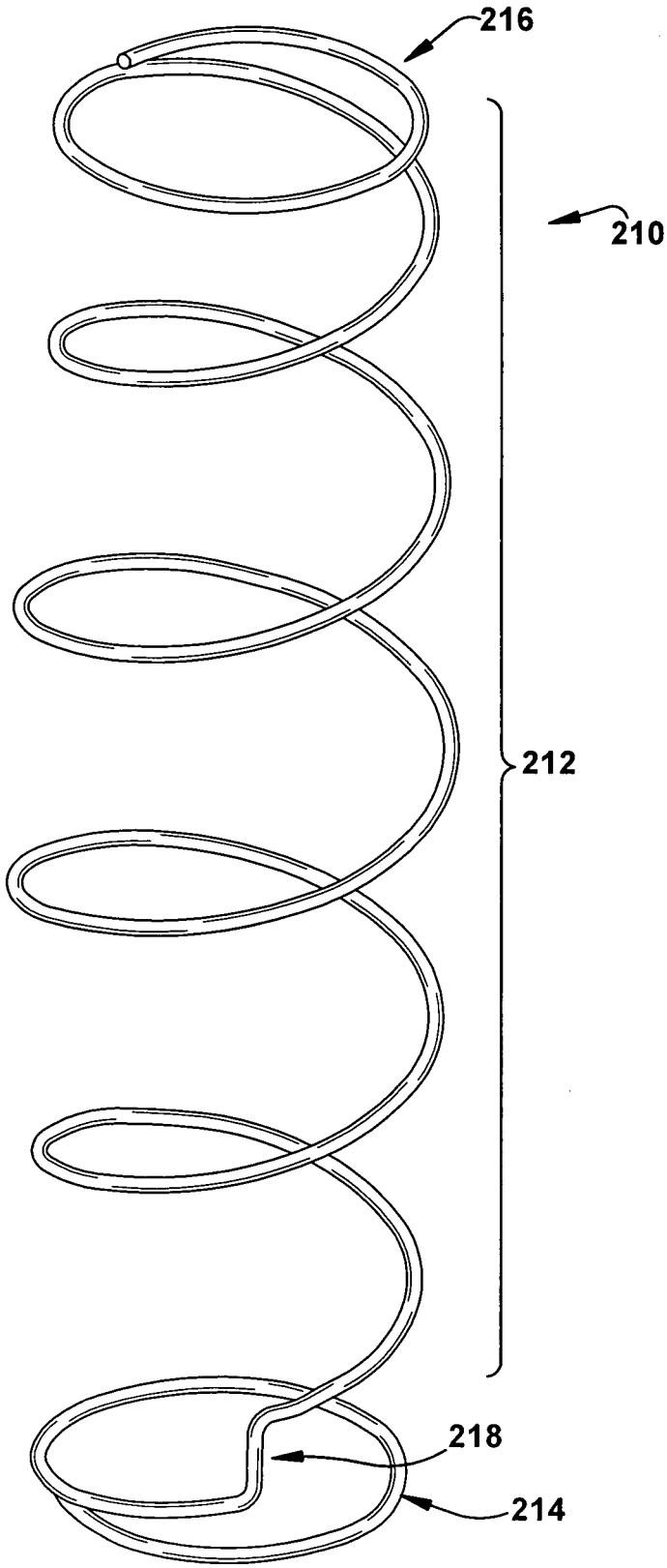
FIGS. 21A-21B are perspective view of pocketed one-step coils.
Figure 21B:
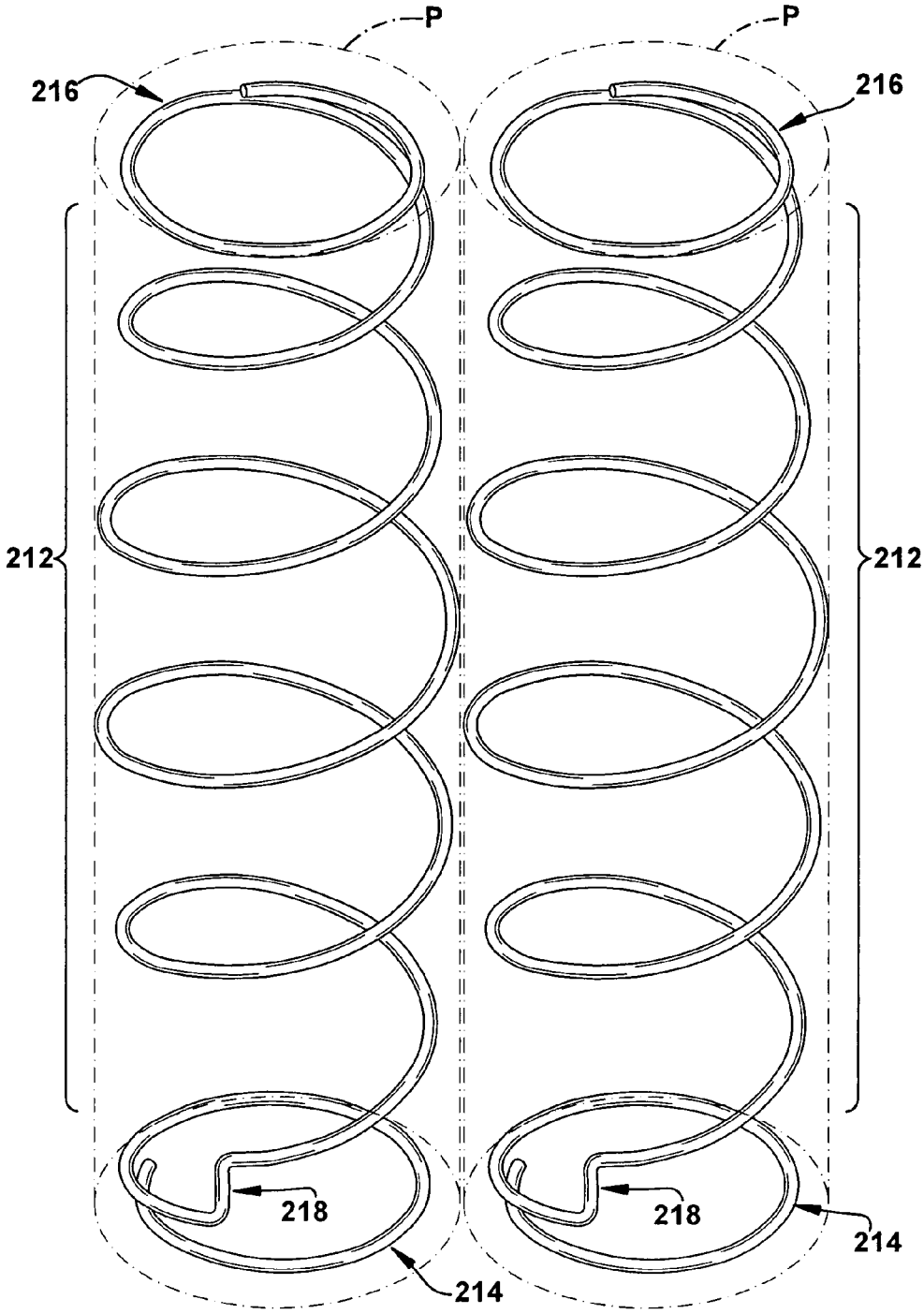

FIGS. 21A and 21B illustrate embodiments of one-step pocketed coils, indicated generally at 210, which are adapted for application as pocketed or Marshall type coils in an innerspring. The one step pocketed coils 210 have a helical coil body 212, and coil ends 214 and 216 which follow the circular path of the coil body. The radii of the coil ends 214 and 216 may be less than the maximum radius of the coil body 202 as shown, or equal to or greater than the radius of the coil body 202. A step 218 is located between one of the coil ends 214, 216 and the coil body 202. The step 218 is generally linear, and generally vertically oriented, and parallel to the longitudinal axis of the coil body 202. The step 218 is the only non-helical or non-circular segment of the coil 210, and functions primarily to extend the overall height of the coil as measured from one end 214 to the other end 216. The step 218 also serves to mount the helical coil body 212 in cantilevered manner whereby the first turn 2121 of the coil body 212 bends relative to the upper end of the step 218. The step 218 is the only non-helical segment of the coil 210 located between the coil ends 214 and 216. As shown in FIG. 21B, the coil 210 is particularly well suited for use as a pocketed coil of greater height because it is readily contained within a pocket P as shown and the step configuration of the coil is concealed by the pocket.

Figure 23:
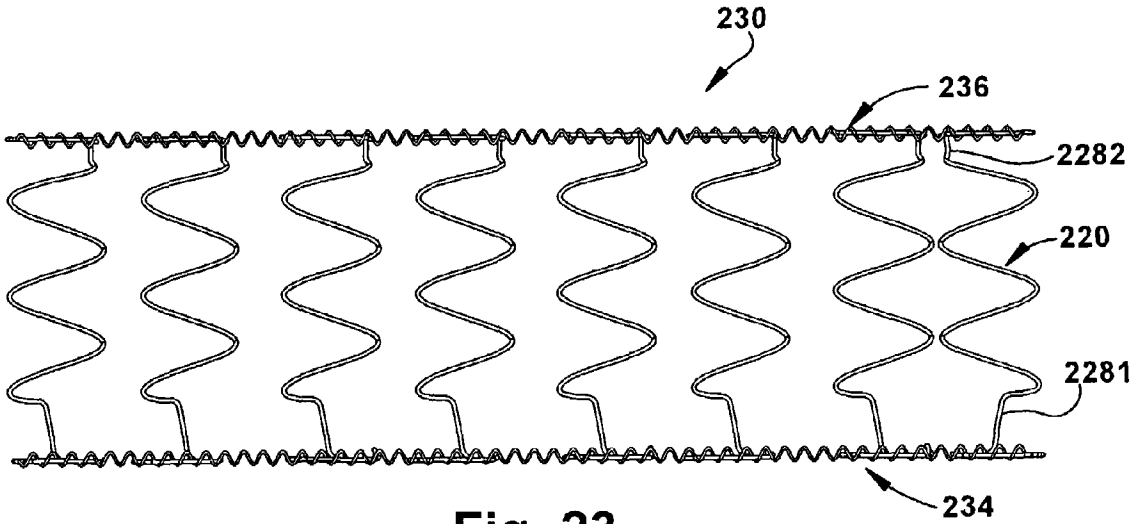
FIG. 23 is a profile view of an innerspring constructed with multi-step coils of the invention.
Figure 22:
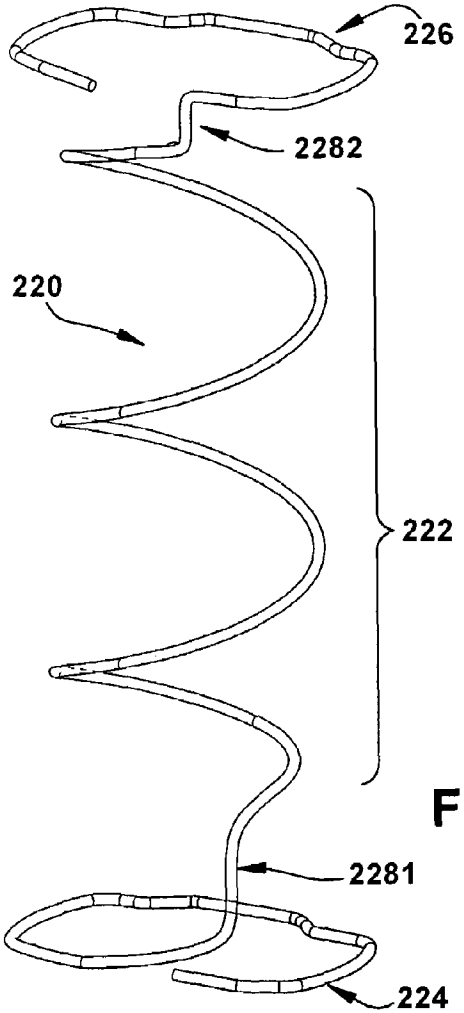
FIG. 22 is a perspective view of a multi-step coil of the invention.

FIG. 22 illustrates another type of coil of the invention, sometimes referred to as a "multi-step coil", indicated generally at 220, which has two steps 2281 and 2282 located proximate to the respective coil ends 224 and 226, and at opposite ends of the coil body 222. As illustrated, the two steps 2281 and 2282 of the coil need not be of the exact same configuration, but may share the common feature of having a generally vertical and non-helical segment, and transitions from that segment to the respective coil end and to the ends of the helical coil body 222. Also as illustrated, one of the steps may have a generally vertical segment which is shorter than a vertical segment of the other step and, as illustrated in FIG. 23, be oriented within an innerspring 230 so that the shorter vertical steps are proximate to ends of the coils which form one of the support surfaces 236 of the innerspring 230, and relatively longer vertical steps are proximate to ends of the coils which form another of the support surfaces 234 of the innerspring 230. As noted, generally a step with a shorter vertical segment will produce a higher degree of flexibility under compression, and so it may be preferable to have the shorter step, such as step 2282, oriented at a primary support surface 236 of the innerspring 230.

Figure 25:
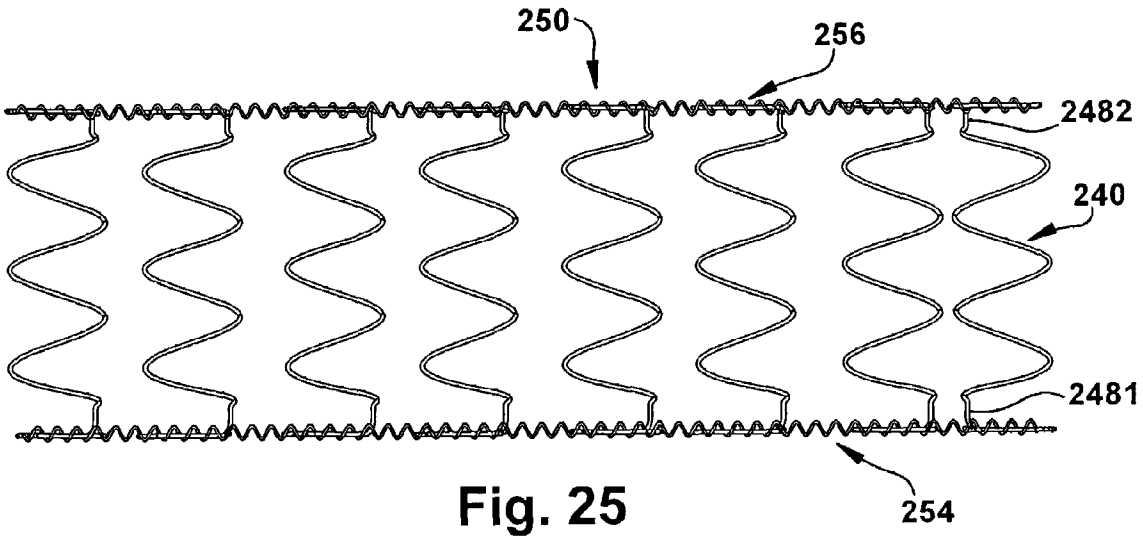
FIG. 25 is a profile view of an innerspring constructed with multi-step coils of the invention.
Figure 24:
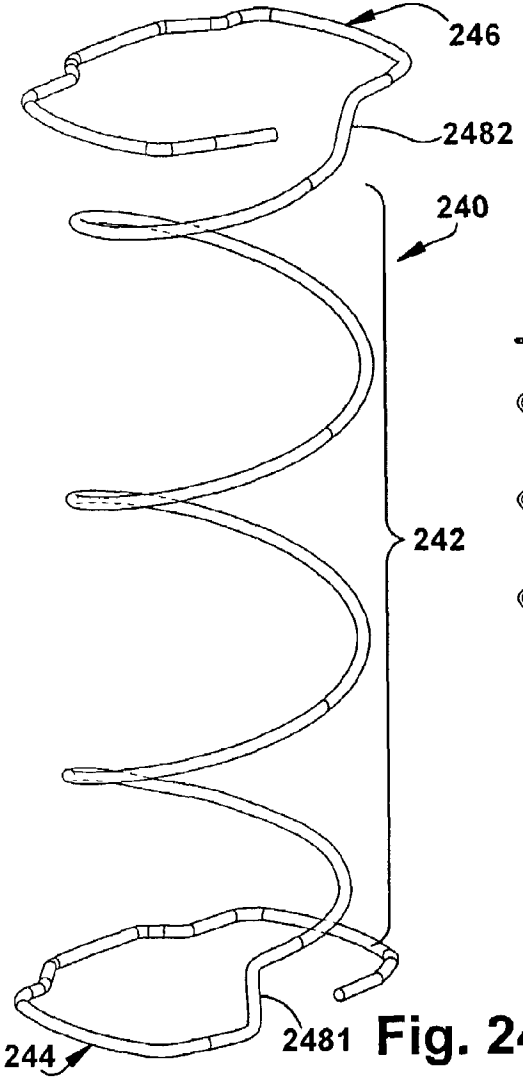
FIG. 24 is a perspective view of an alternate embodiment of a multi-step coil of the invention.

FIG. 24 illustrates another example of a coil 240 which includes two steps, 2481 and 2482, also located proximate to respective ends 244 and 246 of the coil, and at ends of the helical coil body 242. As with coil 230, the steps 2481 and 2482 need not be identically or even similarly configured in shape, length or angle, although there may be some commonality on one or all of these features. For example, as illustrated, one of the steps such as step 2481 may be substantially vertical with respect to coil end 244 and the longitudinal axis of the helical coil body 242, while the step 2482 may be angled with respect to coil end 246 and the longitudinal axis of the coil body 242. By this arrangement, the coil 240 may provide a different support response at the support surface 256 of an innerspring 250 formed by the coil ends 246, as illustrated in FIG. 25, than the surface 254 formed by the coil ends 244. These types of dual-step coils are excellent for use in one-sided innersprings, as the described benefit of reducing the amount of wire is achieved, and the step at the support side or surface of the innerspring can be designed for the desired response to loads, as can the step at the bottom side of the innerspring.

Figure 27:
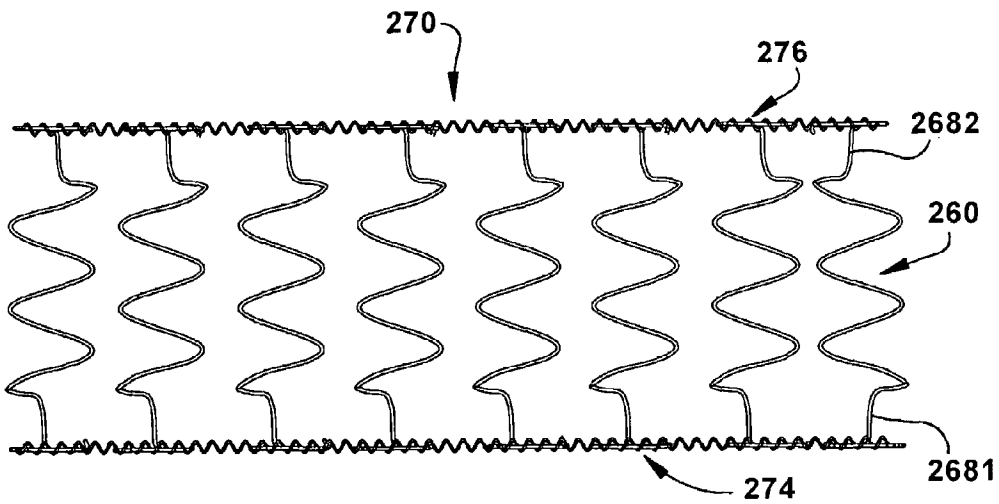
FIG. 27 is a profile view of an innerspring constructed with symmetrical multi-step coils of the invention.
Figure 26:
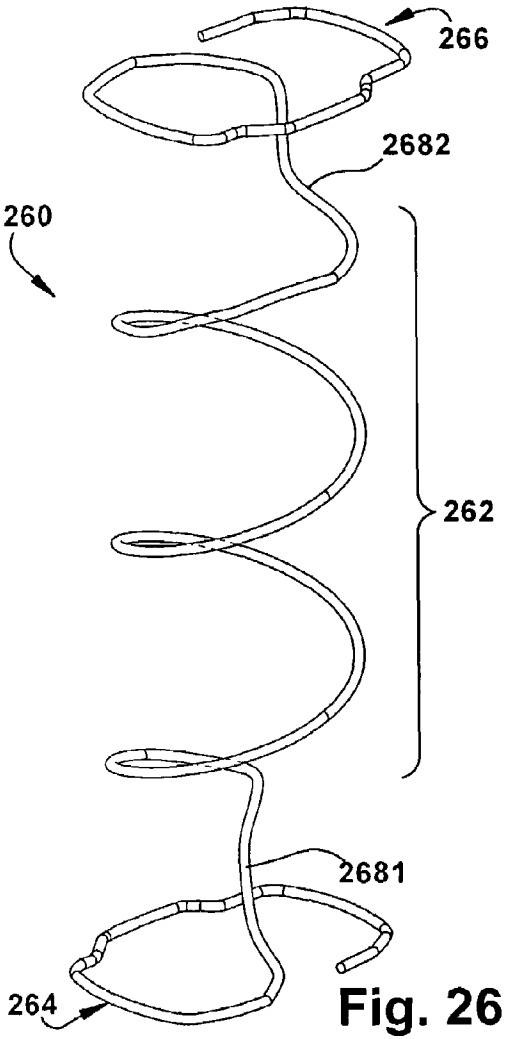
FIG. 26 is a perspective view of a symmetrical multi-step coil of the invention.

FIG. 26 illustrates one example of a coil 260 which has two steps 2681 and 2682 which are substantially similarly configured, and located proximate to the respective coil ends 264 and 266 and at the ends of the helical coil body 262. Coils of this type essentially double the described advantages of the step coil concept, and provide the further advantage of not requiring a particular orientation of an innerspring 270, as illustrated in FIG. 27, with respect to a top or bottom support surface.

Figure 28:
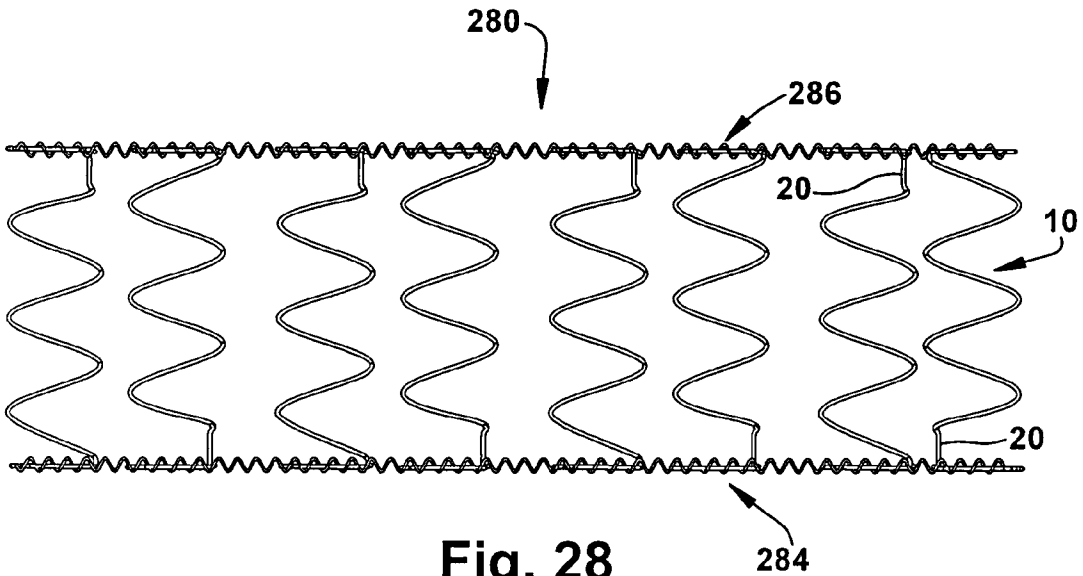
FIG. 28 is a profile view of an innerspring constructed with stepped coils of the invention in alternating orientations.

FIG. 28 illustrates an innerspring 280 in which the orientation of coils are varied within the innerspring, so that the step in one coil may be oriented at an opposite end or innerspring side than the step of an adjacent coil. This innerspring construction can be made with coils having a single step, such as coil 10 described with reference to FIGS. 1A-1E or any of the other coils having one or two steps. alternating the orientation or positions of the coil steps provides blended or tuned support surfaces 284, 286 produces by combinations of the various support characteristics generated by the presence of the steps.

Figure 29:
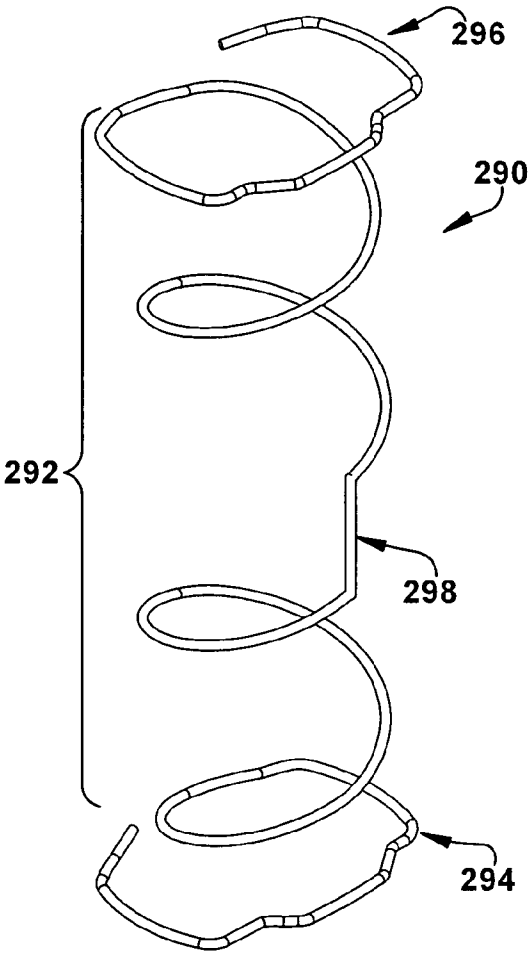
FIG. 29 is a perspective view of an alternate embodiment of a stepped coil of the invention.

FIG. 29 illustrates an alternate embodiment of a one-step coil of the invention, wherein a step 298 is formed within the helical coil body 292 so that the coil body 292 is divided or interrupted by the step 298. In other words, there are two sets of helical turns which make up the coil body 292 in combination with the step. Because the helical form of the coil body 292 is thus contiguous with the coil ends 294, 296, this type of coil has a lower and generally equal spring rate at both of the coil ends. Stiffness of the coil is increased by the step 298, the presence of which is not perceived upon initial compression of the coil. Additional steps can be formed within the coil body, i.e., between the helical turns of the coil body.

What is claimed is:

1. An innerspring having a plurality of wire coils interconnected in an array, each of the wire coils having a generally cylindrical body with two or more helical turns of wire which form a helical path about a longitudinal axis of the coil, the coil body terminating at opposed axial ends, a coil end at each axial end of the coil body, each coil end oriented in a plane which is generally perpendicular to the longitudinal axis of the coil, and a step which extends between one of the coil ends and the coil body and which does not follow the helical path of the coil body;

wherein the each of the coil ends have at least one linear segment, and further comprising a lacing wire which extends between coils and is engaged with linear segments of the coil ends.

2. The innerspring of claim 1 wherein the step of each of the coils is located proximate to a base coil end of the coils which form a base of the innerspring.

3. The innerspring of claim 1 wherein the step in each of the coils is located proximate to a radial edge of the coil body.

4. The innerspring of claim 1 wherein the step in each of the coils is located proximate to the longitudinal axis of the coil body.

5. The innerspring of claim 1 wherein the step in each of the coils has a common length in an approximate range of 10 mm to 40 mm.

6. The innerspring of claim 1 wherein the coils further comprise a transition segment between the coil end and the step.

7. A wire coil for use in an innerspring, the coil having a plurality of helical turns which form a helical coil body about a longitudinal axis of the coil;

a first coil end which extends from one end of the helical coil body, the first coil end located in a plane which is generally perpendicular to the longitudinal axis of the coil;

a second coil end located proximate to an opposite end of the helical coil body, the second coil end located in a plane which is generally perpendicular to the longitudinal axis of the coil;

and a step which extends between the opposite end of the coil body and the second coil end, the step extending out of the plane in which the second coil end is located and not aligned with the helical turn at the opposite end of the coil body;

wherein the first end and second end of the coil body each have at least one linear segment.

8. The coil of claim 7 wherein the step is generally located at an outer radial extent of the coil body.

9. The coil of claim 7 wherein the step is located proximate to the longitudinal axis of the coil.

10. The coil of claim 7 assembled in an innerspring and wherein the step is substantially perpendicular to support surfaces of the innerspring.

11. The coil of claim 7 wherein the step is coaxial with the longitudinal axis of the coil.

12. The coil of claim 7 further comprising a transition segment between the step and the first end or second end of the coil.

13. The coil of claim 7 wherein the step has a linear extent in an approximate range of 10 mm to 40 mm.

14. The coil of claim 7 having a total length measured from the first coil end to the second coil end in the approximate range of 140 mm to 190 mm.

15. The innerspring of claim 14 wherein the step in each of the coils is substantially coaxial with the longitudinal axis of the coil body.

16. The innerspring of claim 14 in a one-sided mattress.

17. A combination of wire coils for use as an innerspring, each of the coils of the combination of wire coils having a plurality of helical turns which form a helical coil body about a longitudinal axis of the coil, and a first coil end which extends from one end of the helical coil body, the first coil end located in a plane which is generally perpendicular to the longitudinal axis of the coil, and a second coil end located proximate to an opposite end of the helical coil body, the second coil end located in a plane which is generally perpendicular to the longitudinal axis of the coil, and a step which extends between the opposite end of the coil body and the second coil end, the step extending out of the plane in which the second coil end is located and not aligned with the helical turn at the opposite end of the coil body;

the combination of wire coils arranged in an array and interconnected by lacing wires which engage the first and second ends of the coils, wherein the step in each of the coils is located proximate to the second end of the coils which form a bottom of the innerspring.

* * * * *